US008378277B2

(12) United States Patent
Sandomirsky et al.

(10) Patent No.: US 8,378,277 B2
(45) Date of Patent: Feb. 19, 2013

(54) OPTICAL IMPACT CONTROL SYSTEM

(75) Inventors: Sergey Sandomirsky, Irvine, CA (US); Vladimir Esterkin, Redondo Beach, CA (US); Thomas C. Forrester, Hacienda Heights, CA (US); Tomasz Jannson, Torrance, CA (US); Andrew Kostrzewski, Garden Grove, CA (US); Alexander Naumov, Rancho Palos Verdes, CA (US); Naibing Ma, Torrance, CA (US); Sookwang Ro, Glendale, CA (US); Paul I. Shnitser, Irvine, CA (US)

(73) Assignee: Physical Optics Corporation, Torrance, CA (US)

( * ) Notice: Subject to any disclaimer, the term of this patent is extended or adjusted under 35 U.S.C. 154(b) by 247 days.

(21) Appl. No.: 12/916,147

(22) Filed: Oct. 29, 2010

(65) Prior Publication Data

US 2012/0211591 A1 Aug. 23, 2012

Related U.S. Application Data

(60) Provisional application No. 61/265,270, filed on Nov. 30, 2009.

(51) Int. Cl.

| | |
|---|---|
| ***F41G 7/22*** | (2006.01) |
| ***F42B 15/01*** | (2006.01) |
| *F41G 7/00* | (2006.01) |
| *F42B 15/00* | (2006.01) |

(52) U.S. Cl. ..... 244/3.16; 244/3.1; 244/3.15; 89/1.11; 102/200; 102/206; 102/211; 102/213; 342/13; 342/14; 342/16; 398/39; 370/203

(58) Field of Classification Search ..... 244/3.1–3.3; 89/1.11; 102/200, 206, 211, 213; 370/203–211; 398/39; 342/13–19; 385/115; 250/200, 250/216, 237 R; 356/3–3.09, 4.01, 5.01, 356/5.05, 5.06, 5.11

See application file for complete search history.

(56) References Cited

U.S. PATENT DOCUMENTS

| | | | | | |
|---|---|---|---|---|---|
| 3,060,857 | A | * | 10/1962 | Smith | 102/213 |
| 3,064,578 | A | * | 11/1962 | Henderson et al. | 102/213 |
| 3,483,821 | A | | 12/1969 | Brothers | |
| 3,782,667 | A | * | 1/1974 | Miller et al. | 244/3.13 |
| 3,786,757 | A | * | 1/1974 | Goldstein et al. | 102/213 |
| 3,837,283 | A | | 9/1974 | McCracken | |
| 3,838,645 | A | * | 10/1974 | Finger et al. | 102/211 |

(Continued)

FOREIGN PATENT DOCUMENTS

| | | |
|---|---|---|
| EP | 264734 A2 | 4/1988 |
| EP | 264734 A3 | 4/1990 |

(Continued)

OTHER PUBLICATIONS

International Search Report and the Written Opinion for International App No. PCT/US2010/057167, completed Feb. 9, 2011.

*Primary Examiner* — Bernarr Gregory

(74) *Attorney, Agent, or Firm* — Sheppard Mullin Richter & Hamton LLP

(57) ABSTRACT

An optical impact system controls munitions termination through sensing proximity to a target and preventing effects of countermeasures on false munitions termination. Embodiments can be implemented on in a variety of munitions such as small and mid caliber that can be applicable in non-lethal weapons and in weapons of high lethality with airburst capability for example and in guided air-to-ground and cruise missiles. Embodiments can improve accuracy, reliability and lethality of munitions depending on its designation without modification in a weapon itself and make the weapon resistant to optical countermeasures.

26 Claims, 27 Drawing Sheets

U.S. PATENT DOCUMENTS 3,860,199 A 1/1975 Dunne
4,098,191 A * 7/1978 Bagwell et al. ..... 102/213
4,146,327 A 3/1979 Harris
4,153,224 A * 5/1979 Rampolla et al. ..... 244/3.16
4,231,533 A * 11/1980 Durig ..... 244/3.16
4,245,560 A * 1/1981 Rambauske ..... 102/213
4,259,009 A * 3/1981 Jernigan ..... 244/3.16
4,310,760 A * 1/1982 Gardner ..... 102/213
4,733,609 A 3/1988 Goodwin et al.
4,738,411 A * 4/1988 Ahlstrom et al. ..... 244/3.15
4,770,482 A * 9/1988 Sweeney et al. ..... 385/115
4,859,054 A * 8/1989 Harrison ..... 102/213
4,896,031 A * 1/1990 Pettersson et al. ..... 250/237 R
4,936,216 A * 6/1990 Skagerlund ..... 102/213
4,987,832 A 1/1991 Klink et al.
4,996,430 A 2/1991 Gupta
5,056,922 A 10/1991 Cielo et al.
5,142,985 A 9/1992 Stearns
5,205,168 A 4/1993 Cattin et al.
5,221,809 A 6/1993 Cuadros
5,601,024 A 2/1997 Sepp et al.
5,613,650 A * 3/1997 Kaifu et al. ..... 244/3.16
5,912,738 A 6/1999 Chason et al.
5,981,965 A 11/1999 Pryor et al.
6,145,784 A * 11/2000 Livingston ..... 244/3.11
6,199,794 B1 * 3/2001 Naiman et al. ..... 244/3.16
6,250,583 B1 * 6/2001 Livingston ..... 244/3.13
6,279,478 B1 8/2001 Ringer
6,298,787 B1 10/2001 Warnagiris
6,302,355 B1 * 10/2001 Sallee et al. ..... 244/3.16
6,343,766 B1 * 2/2002 Livingston ..... 244/3.13
6,504,601 B2 * 1/2003 Ganghofer ..... 356/5.01
6,624,899 B1 9/2003 Clark
6,722,283 B1 4/2004 Dindl et al.
6,769,643 B2 8/2004 Bar et al.
6,829,043 B2 12/2004 Lewis et al.
7,002,699 B2 2/2006 Kong et al.
7,183,966 B1 * 2/2007 Schramek et al. ..... 244/3.1
7,304,283 B2 * 12/2007 Tholl et al. ..... 244/3.16
7,420,196 B2 9/2008 Metcalfe
7,554,076 B2 6/2009 Wang et al.
7,673,565 B1 * 3/2010 Proctor ..... 102/213
7,745,767 B2 6/2010 Bredy
2004/0119035 A1 6/2004 Kong et al.
2006/0158666 A1 7/2006 Schelinski et al.
2007/0193466 A1 8/2007 Guyvarch
2009/0225299 A1 9/2009 Crawford et al.

FOREIGN PATENT DOCUMENTS

EP 264734 B1 3/1992
WO 2009069121 A1 6/2009
WO 2010015860 A1 2/2010

* cited by examiner

OPTICAL IMPACT CONTROL SYSTEM

CROSS-REFERENCE TO RELATED APPLICATIONS

This application claims the benefit of U.S. Provisional Application No. 61/265,270 filed Nov. 30, 2009, and which is hereby incorporated herein by reference in its entirety.

TECHNICAL FIELD

The present invention relates generally to optical detection devices, and more particularly, some embodiments relate to optical impact systems with optical countermeasure resistance.

DESCRIPTION OF THE RELATED ART

The law-enforcement community and U.S. military personnel involved in peacekeeping operations need a lightweight weapon that can be used in circumstances that do not require lethal force. A number of devices have been developed for these purposes, including a shotgun-size or larger caliber dedicated launcher to project a solid, soft projectile or various types of rubber bullets, to inject a tranquilizer, or stun the target. Unfortunately, currently all these weapon systems can only be used at relatively short distances (approximately 30 ft.). Such short distances are not sufficient for the proper protection of law-enforcement agents from opposition force.

The limitation in the performance range of non-lethal weapon systems is generally associated with the kinetic energy of the bullet or projectile at the impact. To deliver the projectile to the remote target with the reasonable accuracy, the initial projectile velocity must be high—otherwise the projectile trajectory will be influenced by wind, atmospheric turbulence, or the target may move during projectile travel time. The large initial velocity determines the kinetic energy of a bullet at the target impact. This energy is usually sufficient to penetrate a human tissue or to cause large blunt trauma, thus making the weapon system lethal.

Several techniques have been developed to reduce the kinetic energy of projectiles before the impact. These techniques include an airbag inflatable before the impact, a miniature parachute opened before the impact, fins on the bullet opened before the impact to reduce the bullet speed, a powder or small particle ballast that can be expelled before the impact to reduce the projectile mass and thus to reduce its kinetic energy before the impact and so on.

Regardless of the technique used for the reduction of the projectile kinetic energy before the impact, it always contains some trigger device that activates the mechanism that reduces the projectile kinetic energy. In the simplest form it can be a timer that activates this mechanism at a predetermined moment after a shot. More complex devices involve various types of range finders that measure the distance to a target. Such range finder can be installed on the shotgun or launcher and can transmit the information about a target range to projectile before a shot. Such type of weapon may be a lethal to bystanders in front of the target who intercept the projectile trajectory after the real target range has been transmitted to the projectile. Weapon systems that carry a rangefinder or proximity sensor on the projectile are preferable because they are safer and better protected from such occasional events.

There are several types of range finders or proximity sensors used in bombs, projectiles, or missiles. Passive (capacitive or inductive) proximity sensors react to the variation of the electromagnetic field around the projectile when target appears at a certain distance from a sensor. This distance is very short (several feet, usually) so they have a short time for the slow-down mechanism to reduce projectile's kinetic energy before it hits the target. Active sensors use acoustic, radio frequency, or light emission to detect a target. Acoustics sensors require relatively large emitting aperture that is not available on a small-caliber projectiles. A small emission aperture also causes spread of radio waves into large angle so any object located aside of a projectile trajectory can trigger a slow-down mechanism thus leaving a target intact. In the contrast, light emission even from a small aperture available on small-caliber projectiles may be made of small divergence so only objects along the projectile trajectory are illuminated. The light reflected from these objects is used in optical range finders or proximity sensors to trigger a slow-down mechanism.

But although the emitted by an optical sensor light can be well collimated, the light reflected from a diffuse target is not collimated so the larger aperture of the receiving channel in optical sensor is highly desirable to collect more light reflected from a diffuse target and thus to increase the range of target detection and to provide more time for the slow-down mechanism to reduce the projectile kinetic energy before the target impact.

A new generation of 40 mm low/medium-velocity munitions that could provide higher lethality due to airburst capability is needed. This will provide the soldiers with the capability to engage enemy combatants in varying types of terrain and battlefield conditions including concealed or defilade targets. The new munition, assembled with a smart fuze, has to "know" how far the round is from the impact point. A capability to burst the round at a predefined distance from the target would greatly increase the effectiveness of the round. The Marine Corps, in particular, plans to fire these smart munitions from current legacy systems (the M32 multishot and M203 under-barrel launcher) and the anticipated XM320 single-shot launcher.

Current technologies involve either computing the time of flight and setting the fuse for a specific time, or counting revolutions, with an input to the system to tell it to detonate after a specific number of turns. Both of these technologies allow for significant variability in the actual height of the airburst, potentially limiting effectiveness. Another solution is proximity fuzes, which are widely used in artillery shells, aviation bombs, and missile warheads; their magnetic, electric capacitance, radio, and acoustic sensors trigger the ordnance at a given distance from the target. These types of fuzes are vulnerable to EMI, are bulky and heavy, have poor angular resolution (low target selectivity), and usually require some preset mechanism for activation at a given distance from the target.

BRIEF SUMMARY OF EMBODIMENTS OF THE INVENTION

According to various embodiments of the invention an optical impact system is attached to fired munitions. The optical impact system controls munitions termination through sensing proximity to a target and preventing effects of countermeasures on false munitions termination. Embodiments can be implemented on in a variety of munitions such as small and mid caliber that can be applicable in non-lethal weapons and in weapons of high lethality with airburst capability for example and in guided air-to-ground and cruise missiles. Embodiments can improve accuracy, reliability and lethality of munitions depending on its designation without modification in a weapon itself and make the weapon resistant to optical countermeasures.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
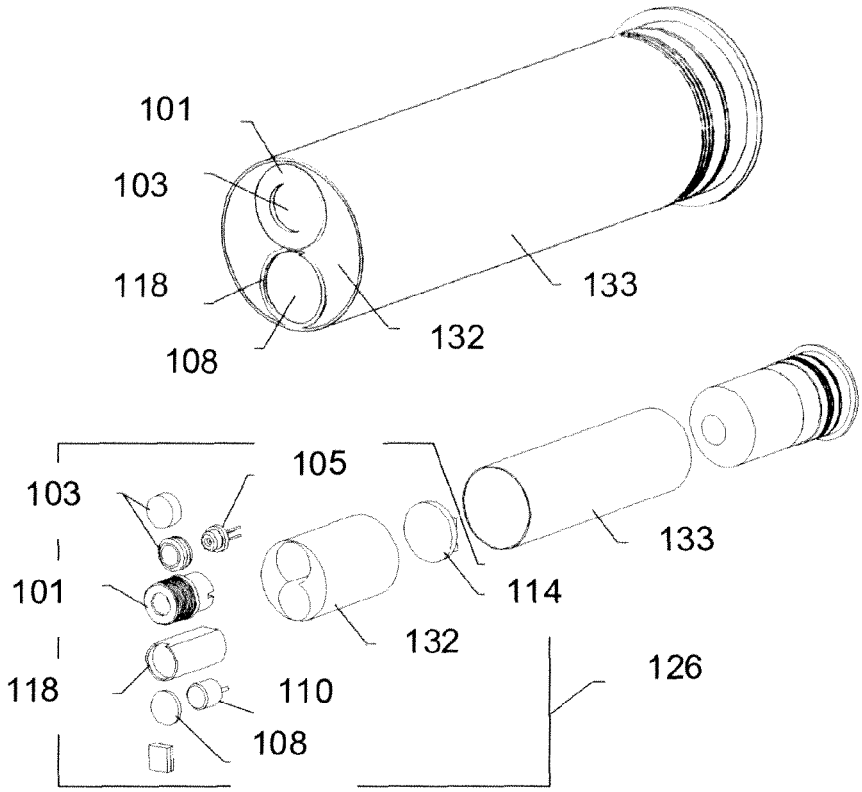
FIG. 1 illustrates a first embodiment of the present invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

An embodiment of the present invention is an optical impact system installed on a plurality of projectiles of various calibers from 12-gauge shotgun rounds through medium caliber grenades to guided missiles with medium or large initial (muzzle) velocity that can detonate high explosive payloads at an optimal distance from a target in airburst configuration or can reduce the projectile's kinetic energy before hitting a target located at any (both small and large) range from a launcher or a gun. In some embodiments, optical impact system comprises a plurality laser light sources operating at orthogonal optical wavelengths and signal analysis electronics minimizes effects of laser countermeasures to reduce false fire probability. The optical impact system may be used in non-lethal munitions or in munitions with enhanced lethality. The optical impact system may include a projectile body, which it is mounted on, a plurality of laser transmitters and photodetectors implementing a principle of optical triangulation, a deceleration mechanism (for non-lethal embodiments) that is activated by an optical trajectory, an expelling charge with a fuse also activated by an optical impact system, and a projectile payload.

In a particular embodiment the optical impact system is comprised of two separate parts of the approximately equal mass. One of these parts includes a light source comprised of a laser diode and collimating optics that direct a light emitted by a laser diode parallel to the projectile axes. The second part includes receiving optics and a photodetector located in a focal plane of the receiving optics while being displaced at a predetermined distance from the optical axis of the receiving optics. Both parts of the optical impact system are connected to an electric circuit that contains a miniature power supply (battery) activated by an inertial switch during a launch, a pulse generator to send light pulses with a high repetition rate and to detect the reflected from a target light synchronously with the emitted pulses; and a comparator that activates a deceleration mechanism and a fuse when the amplitude of the reflected light exceeds the established threshold. In further embodiments, a spring or explosive between sensor parts separates the parts after they are discharged from the projectile.

In another embodiment, the optical impact system is disposed in an ogive of an airburst round. The optical impact system comprises of a laser diode with a collimating optics disposed along the central axes of a projectile and an array of photodetectors arranged in an axial symmetric pattern around the laser diode. When any light reflecting object intersects the projectile trajectory within a certain predetermined distance in front of the projectile, an optical impact system generates a signal to the deceleration mechanism and to the fuse. The fuse ignites the expelling charge that forces both parts of the proximity sensor to expel from a projectile. The recoil from the sensor expel reduces the momentum of the remaining projectile and reduces its kinetic energy so more compact deceleration mechanism can be used to further reduce the projectile kinetic energy to a non-lethal level. The sensor expel also cleans the path to the projectile payload to hit a target. Without a restraint from a projectile body, springs initially located between two parts of a sensor force their separation such that each of them receives a momentum in the direction perpendicular to the projectile trajectory to avoid striking the target with the sensor parts.

In this embodiment, the deceleration mechanism needs a certain time for the reduction of the kinetic energy of the remaining part of projectile to the safe level. The time available for this process depends on the distance at which a target can be detected. In some embodiments, an increase in detecting range at a given pulse energy available from a laser diode is achieved by using a special orientation of the laser diode with its p-n-junction being perpendicular to the plane where both the receiver and the emitter are located. In the powerful laser diodes used in the proximity sensors the light is emitted from a p-n junction that usually has a thickness of approximately 1 μm and its width is several micrometers. After passing the collimating length, the light beam has an elliptical shape with the long axes being in the plane perpendicular to the p-n junction plane. The light reflected from a diffuse target is picked-up by a receiving lens, which creates an elliptical image of the illuminated target area in the focal plan. The long axis of this spot is perpendicular to the plane where a light emitter and a photodetector are located. The movement of the projectile towards the target causes displacement of the spot in the focal plane. When this spot reaches the photosensitive area on a photodetector, a photocurrent is generated and compared with a threshold value. The photocurrent will reach the threshold level faster with the spot oriented as described above so the sensor performance range can be larger and the time available for the deceleration mechanism to reduce the projectile velocity is larger thus enhancing security of the non-lethal munitions usage.

In further embodiments, an anti-countermeasure functionality of optical impact system is implemented to reduce a probability of false fire which can be caused by laser countermeasure transmitting at the same wavelength as an optical impact system and with the same modulation frequency. The anti-countermeasure embodiment of an optical impact system uses a plurality of light sources transmitting at different wavelengths and signal analysis electronics generates an output fire trigger signal only if reflected signal in both wavelengths with modulation frequency identical to the transmitting light will be detected. There is a low probability that a countermeasure laser source will transmit a decoy irradiation in all plurality of an optical impact system wavelengths and modulation frequencies.

An embodiment of the invention is now described with reference to the Figures, where like reference numbers indicate identical or functionally similar elements. The components of the present invention, as generally described and illustrated in the Figures, may be implemented in a wide variety of configurations. Thus, the following more detailed description of the embodiments of the system and method of the present invention, as represented in the Figures, is not intended to limit the scope of the invention, as claimed, but is merely representative of presently preferred embodiments of the invention.

FIG. 1 illustrates a first embodiment of the present invention. The sensor 126 is designed to focus light on a surface, collect and focus the reflected light, and detect the reflected light. A sensor 126 includes a light source, such as a laxer diode 105. In some embodiments, the laser diode 105 may comprise a vertical cavity surface emitting (VCSEL) laser diode, or an edge-emitting laser diode such as a separate-confinement heterostructure (SCH) laser diode. The components of the sensor 126 are located in the main housing 132. Within the main housing 132 are the laser housing 101 and detector housing 118. The laser housing 101 contains the collimating optics 103 and laser diode 105. In some embodiments, the collimating optics 103 may comprise a spherical or cylindrical lens. The detector housing 118 contains the focusing lens 108 and detector 110. In some embodiments, the focusing lens 108 may be a spherical or cylindrical lens. A printed circuit board (PCB) 114, containing the electronics required to properly power the laser diode 105, is located behind the main housing 132. The main housing is insertable into a cartridge housing 133 to attach to the projectile.

In the illustrated embodiment, the sensor 126 also includes an optical projection system configured such that the light from the laser diode 105 is substantially in focus within a predetermined distance range. In the illustrated embodiment, the optical projection system comprises collimating lens 108 which intercepts the diverging beam (for example, beam 327 of FIG. 3) coming from the laser diode 105 and produces a collimated beam (for example, beam 328 of FIG. 3) to the illumination spot of the target surface (for example, target 339 of FIG. 3). A collimated beam provides a more uniform light spot across a distance range compared to a beam focused to a particular focal point. However, in other embodiments, the projection system may include converging lenses, including cylindrical lenses, focused such that the beam is substantially in focus within the predetermined distance range. For example, the image plane may be at a point within the predetermined distance range, such that at the beginning of the predetermined distance range, the beam is suitably in focus for detection.

Naturally, different surfaces demonstrate various reflective and absorption properties. In some embodiment, to ensure that enough reflected light from various surfaces is reached at the receiving lens 108 and subsequently the detector 110 the operating power of the laser can be increased. This can be achieved while still maintaining low power consumption by modulating the laser diode 105. Furthermore, power the laser diode 105 in pulsed mode operation, as opposed to continuous wave (CW) drive, also allows higher power output.

However, even with enough reflected light from the surface (for example, target 339 of FIG. 3), the detection range of the sensor is inherently limited due to the field-of-view of the receiving optics 108 and its ability to collect and focus the reflected light to the detector 110. Accordingly, in some embodiments, the distance range that prompts activation of the fuze may be tailored according to these parameters. When any object is introduced into the path of the laser beam spot (for example, beam 328 of FIG. 3), light is reflected from its surface. An optical imaging system, for example including an aperture and receiving lens 108 collects the reflected light and produces a converging beam (for example, beam 331 of FIG. 3) to the detector 110. In some embodiments, only the detection of an object within a predetermined distance is required, and the detector 110 comprises only a single pixel, non position-sensitive detector (PSD). Furthermore, no specialized processing electronics for calculating actual distance is necessary.

Figure 2:
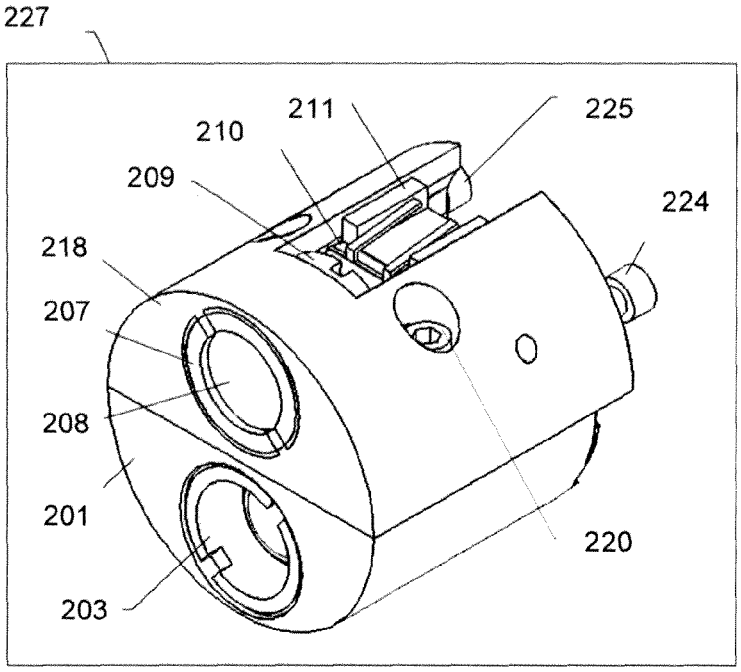
FIG. 2 illustrates a particular embodiment of the invention in assembled and exploded views.
Figure 2:
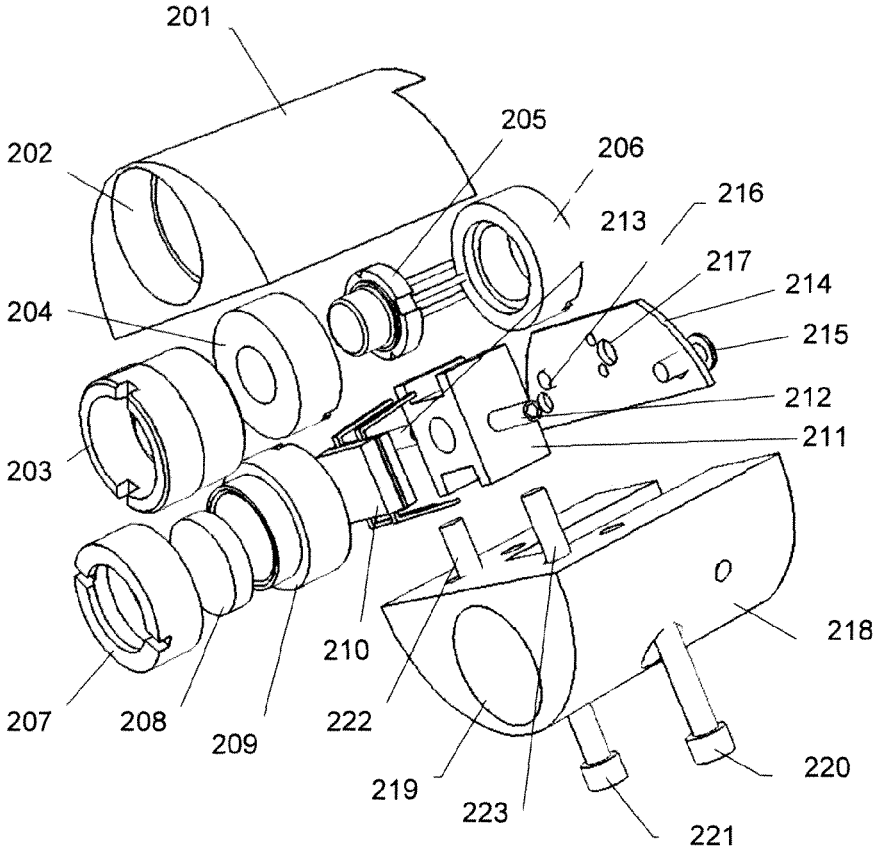

FIG. 2 illustrates a particular embodiment of the invention in assembled and exploded views. The illustrated embodiment may be used as an ultra-compact general purpose proximity sensor 227. the sensor 227 is designed to focus light on a surface, collect and focus the reflected light, and detect the reflected light. The sensor 227 consists of two separable sections; the laser housing 201 and the detector housing 218. the laser housing 201 has a mounting hold 202 in which the collimating optics 203, laser holder 204, laser diode 205, and laser holder clamp 206 are inserted. A PCB 214 mounts directly to the back of the laser housing 201 and contains a socket 217 from which the pins of the laser diode 205 protrude. The detector housing 218 has a mounting hole 219 in which the lens holder 207, focusing lens 208, lens holder clamp 209, photodetector IC 210, photodetector IC holder 211, and several screws 212, 213, 215, 220, 221, 222, 223. A battery compartment (not shown) may be positioned anterior to the housings 201 and 208 to power the system.

Figure 3:
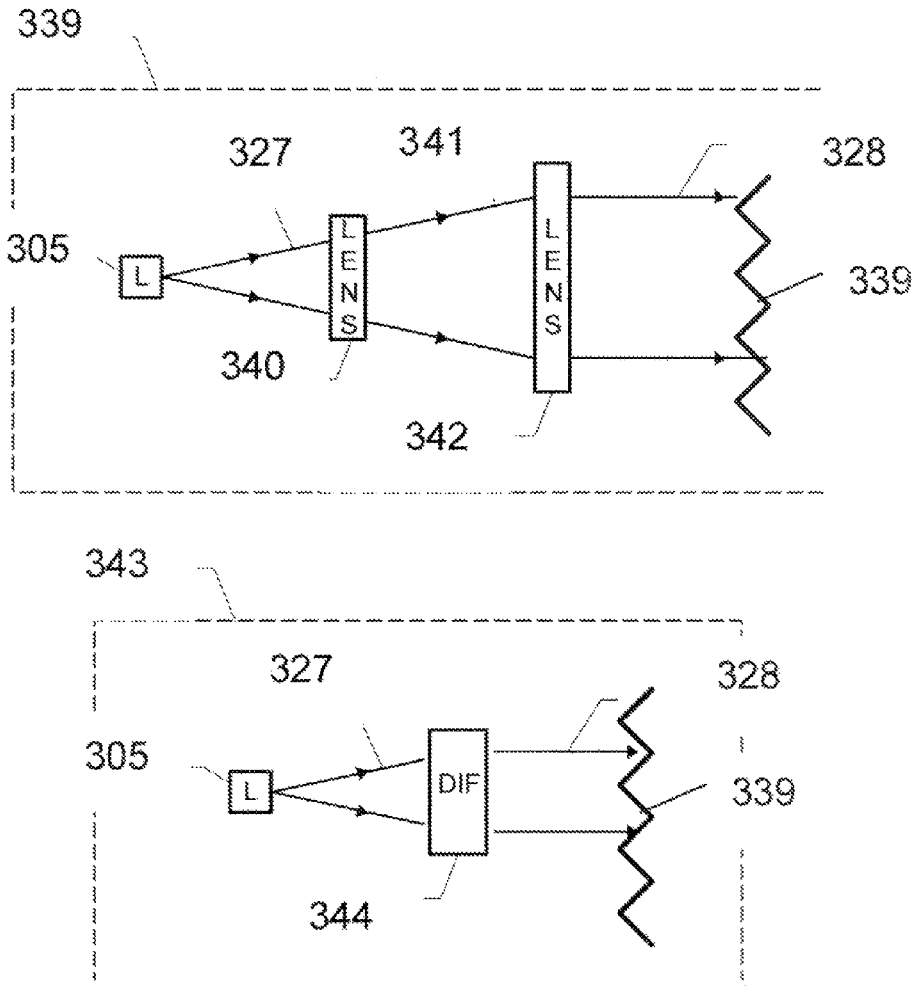
FIG. 3 is a schematic diagram illustrating two different configurations of light source optics using a laser source implemented in accordance with embodiments of the invention.

FIG. 3 is a schematic diagram illustrating two different configurations of light source optics using a laser source implemented in accordance with embodiments of the invention. In the first configuration 339, the laser 305 emits a beam 327. A circular lens 340 collects laser beam 327 and creates an expanded beam 341. A cylindrical lens 342 collects the expanded beam 341 and creates a collimated beam 328. In the second configuration 343, the laser beam 327 from the laser 305 is collected by a holographic light shaping diffuser 344, which produces a collimated beam 328.

Figure 4:
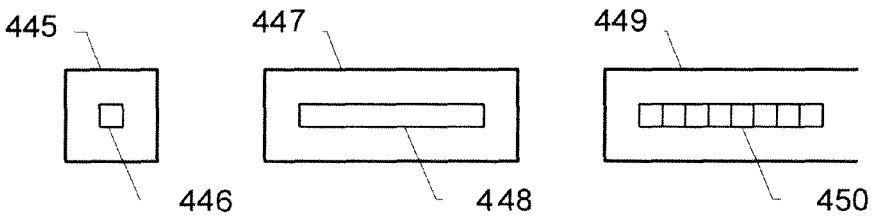
FIG. 4 is a diagram illustrating three different detector types, implemented in accordance with embodiments of the invention.

FIG. 4 is a diagram illustrating three different detector types, implemented in accordance with embodiments of the invention. The first type is a non position-sensitive detector (PSD) 445, which has a single-pixel 446 as the active region. The second detector type shown is a single-pixel PSD 447. Though only a single-pixel 448, its active area is manufactured in various lengths and is capable of detecting in one dimension such as in distance measurement. This single-pixel PSD 447 generates a photocurrent from the received light spot from which its position can be calculated relative to the total active area. The third detector type shown is a single-row, multi-pixel PSD 449, which is also capable of detecting in one dimension. In this detector's 449 configuration, the active area 450 is implemented as a single row of multiple pixels. With detector 449 position may be determined according to which pixels of the array are illuminated.

Figure 5:
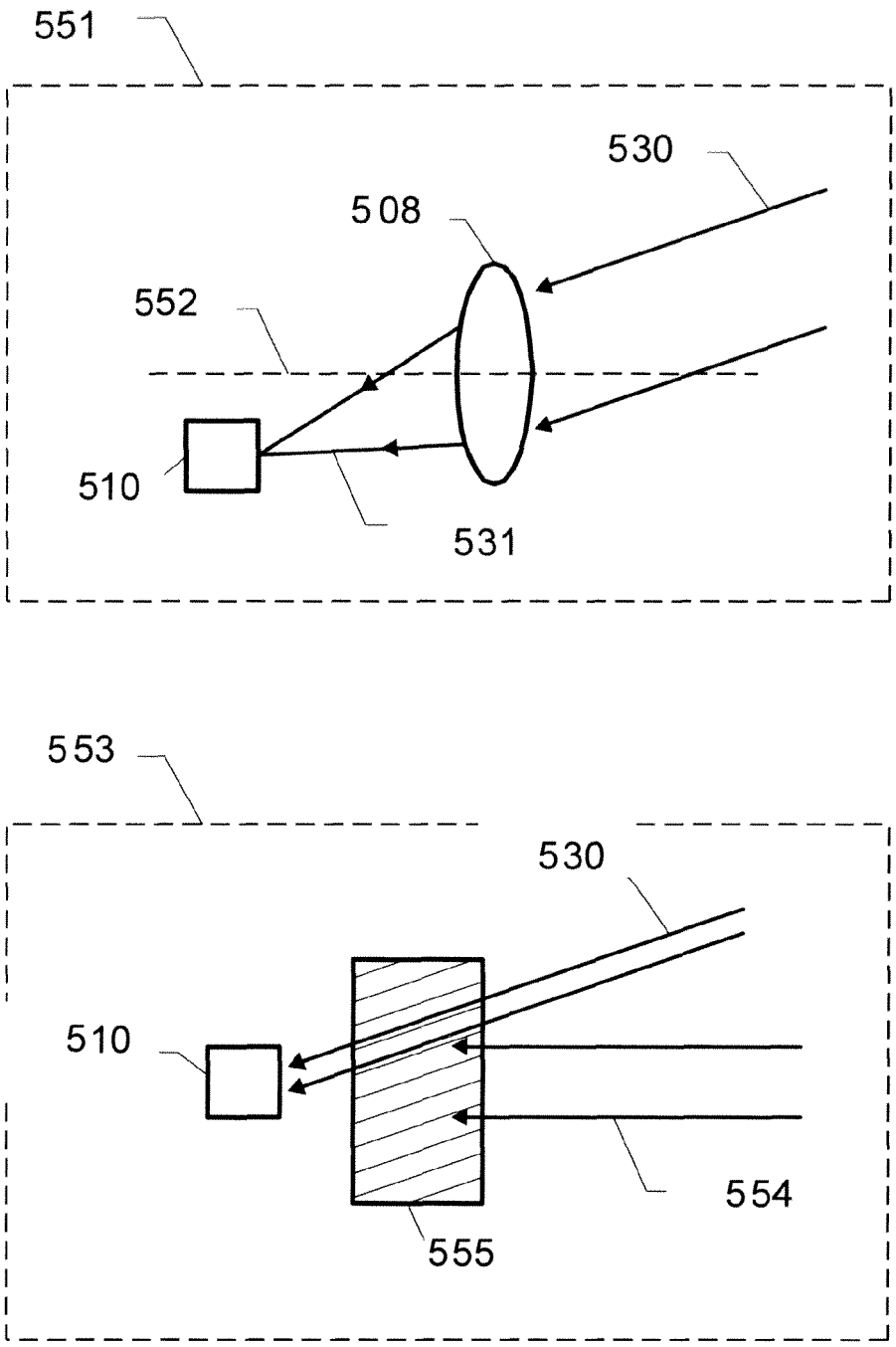
FIG. 5 is a schematic diagram illustrating two different configurations of the detector optics implemented in accordance with embodiments of the invention.

FIG. 5 is a schematic diagram illustrating two different configurations of the detector optics implemented in accordance with embodiments of the invention. In the first configuration 551, the reflected beam 530 enters the focusing lens 508 from an angle. To compensate for the angle of the incoming reflected beam 530, the detector 510 is shifted perpendicularly from the optical axis 552 of the focusing lens 508. In the second configuration 553, only the reflected beam 530 enters the microchannel structure 555, while stray light 554 will be blocked.

Figure 6:
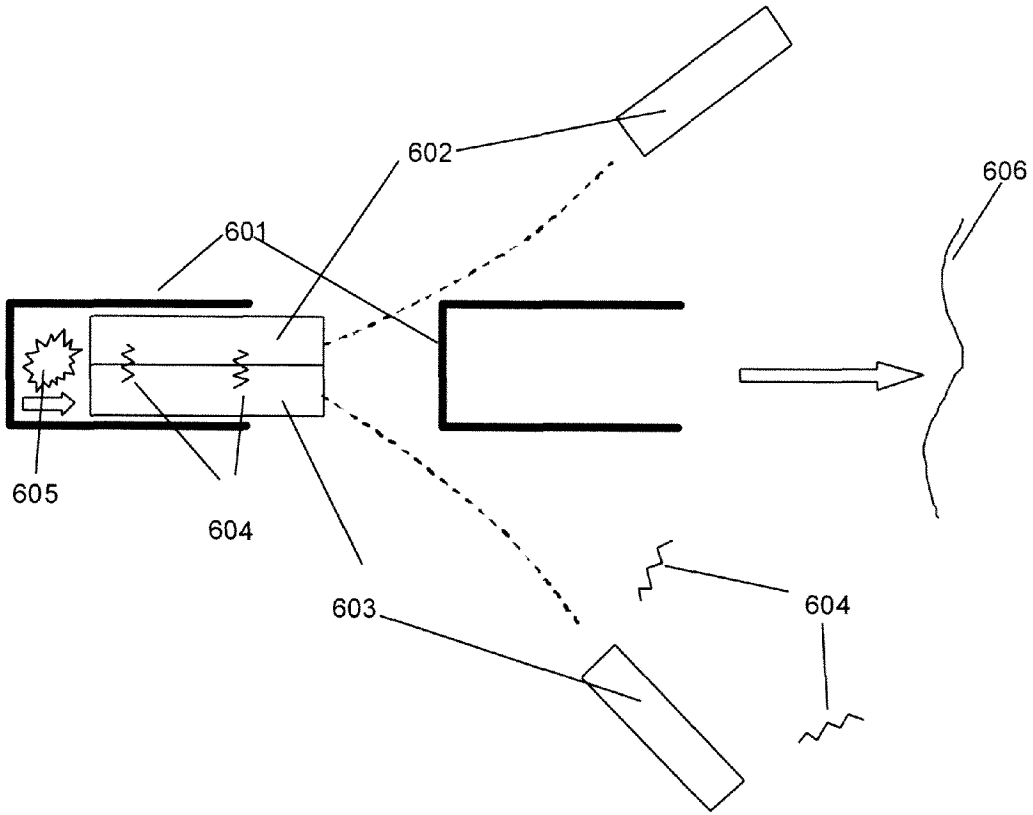
FIG. 6 illustrates the operation of a splitting mechanism according to an embodiment of the invention.

FIG. 6 illustrates the operation of a splitting mechanism according to an embodiment of the invention. Upon detection of target 606 within a predetermined distance range of the projectile, an explosive charge 605 ejects the laser housing 602 and the detector housing 603 from the cartridge 601. In some embodiments, this also assists in slowing the projectile. Once ejected springs 604 separate the laser housing 602 and the detector housing 603, thereby clearing the projectile's trajectory. In an alternative embodiment, rather than, or in addition to, springs 604, an explosive charge may be used to separate housings 602 and 603.

Figure 7:
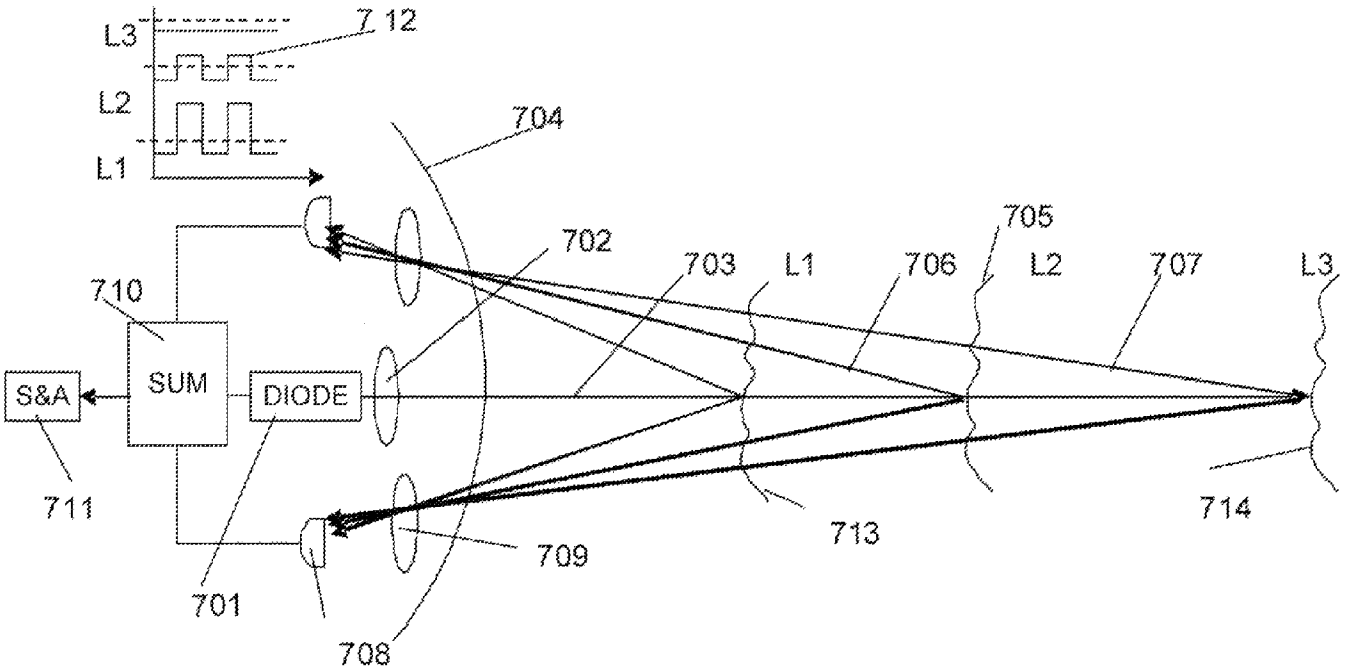
FIG. 7 illustrates an embodiment of the invention implemented in conjunction with medium caliber projectiles with airburst capabilities.

FIG. 7 illustrates an embodiment of the invention implemented in conjunction with medium caliber projectiles with airburst capabilities. The illustrated embodiment comprises a compact proximity sensor attached to an ogive 704 of a medium caliber projectile. The laser diode 701 emits a modulated laser beam oriented along the longitudinal axes of the projectile and which is collimated by a collimating lens 702. Photodetectors 708 are arranged in an axial symmetrical pattern around the laser diode 701. Optical arrangement of a focusing lens 709 and a photodetector 708 produces an output electrical signal 712 from a photodetector only if a reflecting target 705 or 713 is located in front of the projectile at a distance less than a predefined standoff range. A target 714 located at a distance longer than a standoff range does not produce an output electrical signal 1712. An array of axial symmetrical detectors makes target detection more reliable and enhances detector sensitivity. Output analog electrical signals from each photodetector 708 are gated in accordance with the laser modulation frequency and then, instead of immediate thresholding, they are transmitted to electronic circuitry 710 for summation. Summation of signals increases the signal to noise ratio. After summation the integrated signal is thresholded and delivered to a safe & arm 711 device of the projectile initiating its airburst detonation.

Figure 8:
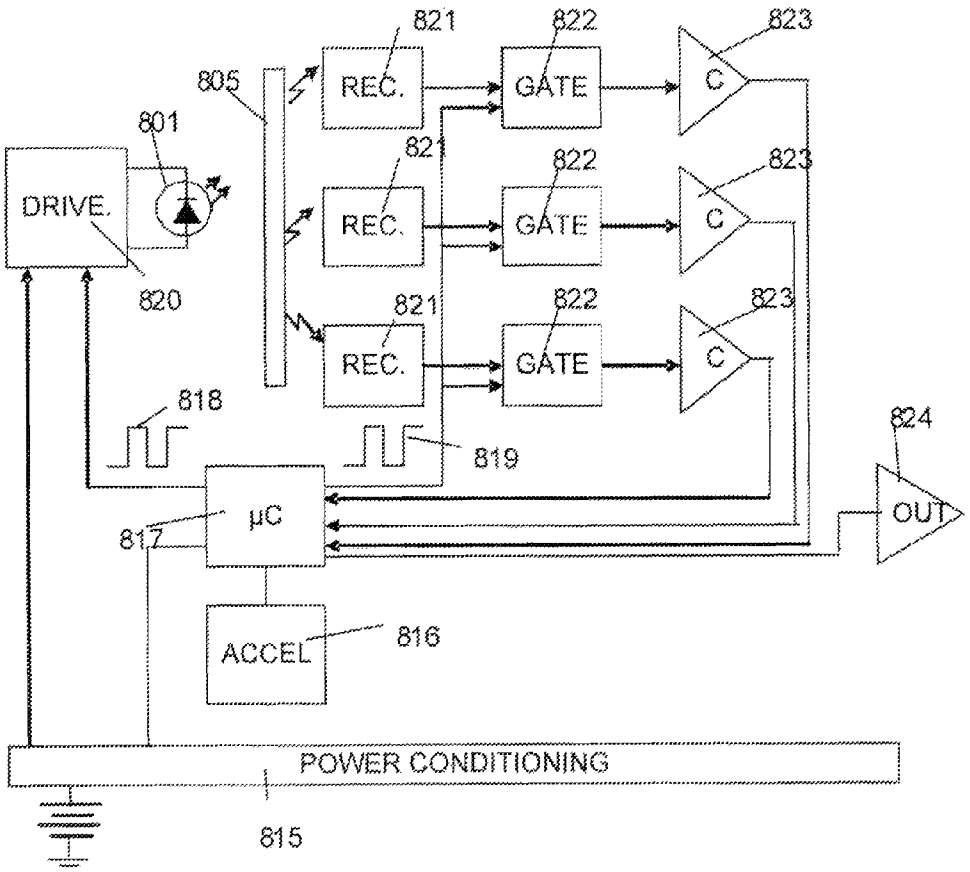
FIG. 8 illustrates a schematic diagram of electronic circuitry of implemented in accordance with an embodiment of the invention.

FIG. 8 illustrates a schematic diagram of electronic circuitry of implemented in accordance with an embodiment of the invention. When the projectile receives acceleration in the barrel, an accelerometer 816 initiates operation of a signal generator inside a microcontroller 817, which produces identical driving signals 818 to start and drive a laser driver 820 and gaiting electronics 821 of a photodetector. An optical receiver 821 receives the light signal reflected from a target surface 805 and generates an output analog electrical signal, which is gated 822 and detected synchronously with a laser diode 801 operation. Gated signals are conditioned 823 and summated in a microcontroller 817. The output threshold signal 824 releases the safe & min device of the projectile, which initiates a projectile explosive detonation. A power conditioning unit 815 supplies with electrical power a laser driver 820, microcontroller 817 and an accelerometer switch 816.

Figure 9:
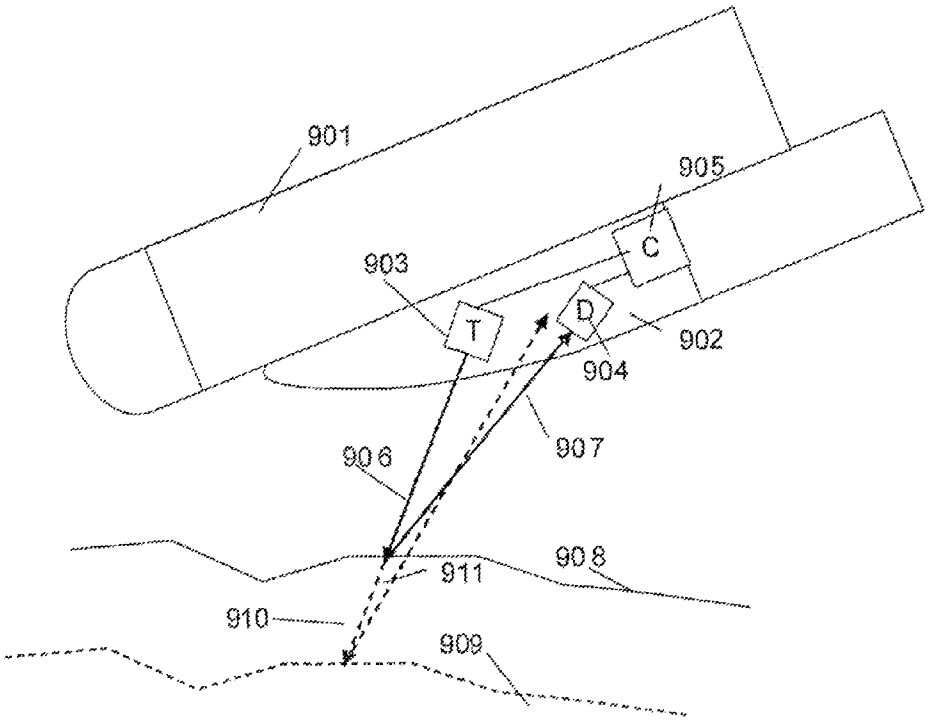
FIG. 9 illustrates a further embodiment of the invention.

FIG. 9 illustrates a further embodiment of the invention. The optical impact system 902, 903, 904 and 905 in the illustrated embodiment is attached to a missile projectile 901. The air-to-ground guided missile approaches to a target 908, 909 under variable angle. In this embodiment, the missile trajectory is stable (not spinning). The optical impact system has a down looking configuration enabling it to identify the appearance of a target at a predefined distance and trigger a missile warhead detonation in an optimal proximity to the target. A laser transmitter 903 of an optical impact system transmits modulated light 906, 910 toward a potential target 908, 909. The light reflected from a target depending on a distance to the target can either impact 907 the photodetector 904 or miss 911 the photodetector. Control electronics 905 for driving and modulation of laser light and for synchronous detection of a reflected light is disposed inside the optical impact system housing 902.

Figure 10:
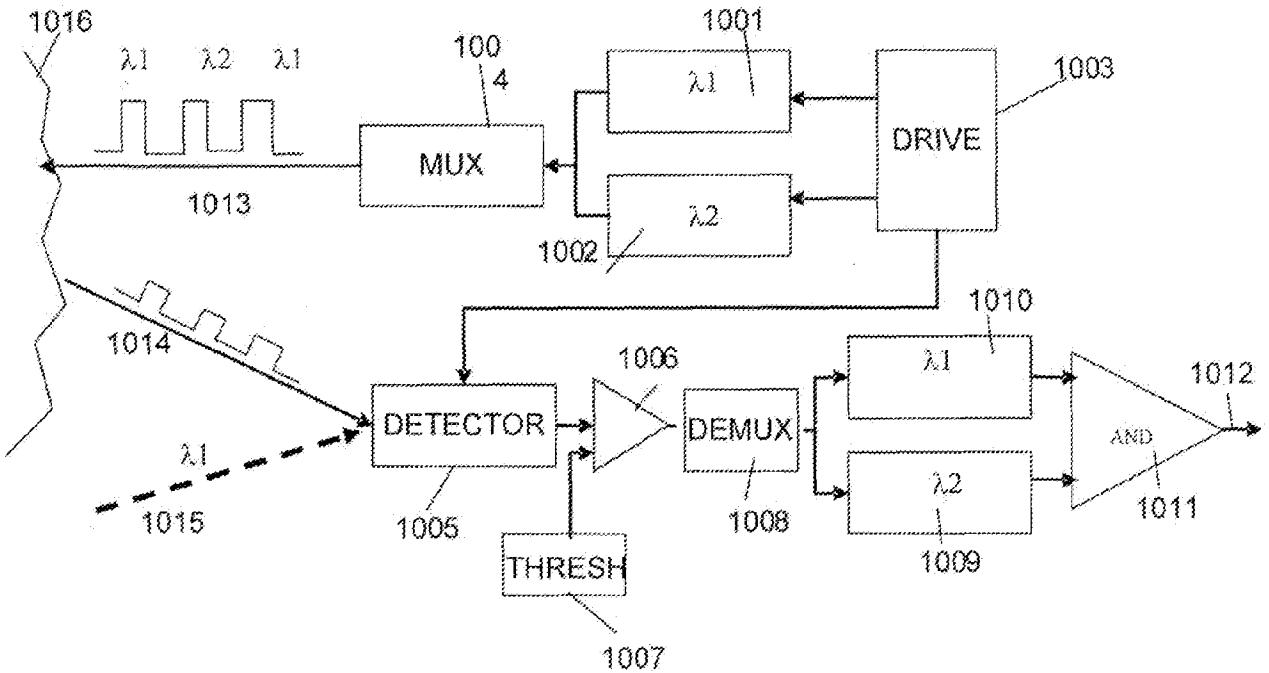
FIG. 10 illustrates an optical impact system with anti countermeasure functionality implemented in accordance with an embodiment of the invention.

FIG. 10 illustrates an optical impact system with anti countermeasure functionality implemented in accordance with an embodiment of the invention. Optical impact system anti countermeasure functionality can be implemented by a plurality of laser sources 1001, 1002 operating in different wavelengths. The laser sources are controlled by an electronic driver 1003 which provides amplitude modulation of each laser source and controls synchronous operation of a photodetector 1005. The plurality of laser beams at a plurality of wavelengths is combined into a single optical path 1013 using time domain multiplexer and a beam combiner 1004. The light reflected from a target 1016 located at a predefined distance contains all transmitted wavelengths 1014. It will be acquired by a receiving tract comprising a photodetector 1005, comparator 1006, demultiplexer 1008 and signal analysis electronics 1009 and 1010 for each plurality of input signals. Electronic AND logic circuit 1011 will generate output trigger signal 1012 only if valid signal will be presented in each of wavelengths channels. Laser countermeasure 1015 will operate with high probability at a single wavelength and will deliver a signal to AND logic only in one channel thus output trigger signal will not be generated.

Figure 11:
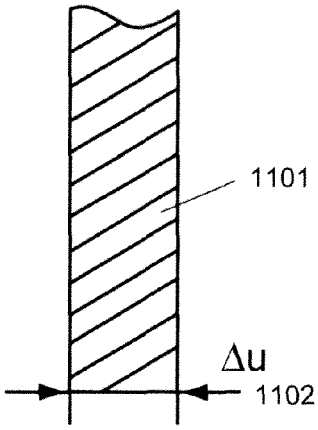
FIG. 11 illustrates the geometry of an edge emitting laser.

FIG. 11 illustrates the geometry of an edge emitting laser. In some embodiments of the invention, the light from the laser source is projected onto a target and imaged at a photodetector. As used herein, the term "Source Contour Imaging" (SCI) means low-resolution imaging of source's strip thickness. As illustrated in FIG. 11, a laser source 1101 has a thickness Δu, 1102, which will be used in calculations herein. In various embodiment, the source strip parameters are controlled for optical triangulation (OT) which is applied for SCI sensing. The OT-principle is based on finding location for center of gravity of the source strip, by two-lens system. In some embodiments, both lenses (one at the emitter and one at the detector) are applied for imaging of 1D-dimension; thus, both are cylindrical with lens curvature in the same plane which is also the plane perpendicular to the sources strip.

Figure 12:
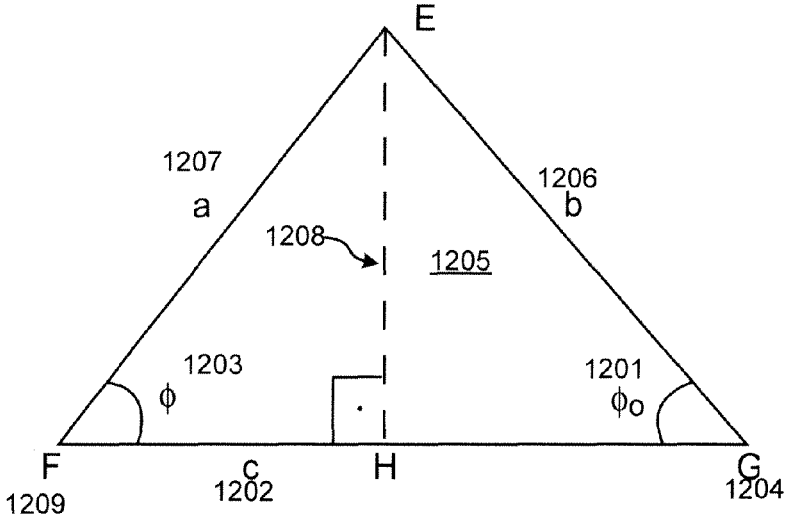
FIG. 12 illustrates an optical triangulation geometry.

FIG. 12 illustrates an optical triangulation geometry. Knowing one side (FG) 1202 and two close angles (ϕ 1203, $\phi_0$ 1201) of the triangle FEG 1205, as in FIG. 12, we can find all remaining elements of the triangle, such as sides a 1207 and b 1206, and its height EH 1208. Point G 1204 is known (it is the center of the laser source), and angle $\phi_o$ 1201, is known (it is the source's beam direction). When we measure the center of gravity of Source Contour Image (SCI) strip, we determine point F 1209, then side: c=FG 1202 is found, and also angle ϕ 1203 is found. Therefore, according to OT-principle, all other triangle elements are found. In practical case, c<<a, and c<<b. This is because a, b are on the order of meters, while c is on the order of centimeters. Therefore, both angles (ϕ, $\phi_o$) must be close to 90°. According to FIG. 2, EH 1208=α sin ϕ. However, the accuracy of ϕ-angle measurement is very good:

$$\delta\phi = \frac{\delta c}{a} \cong \frac{20\ \mu m}{10\ \text{m}} = 2\cdot 10^{-6} \tag{1}$$

This is because the center of gravity F 1209 is measured with accuracy: δc≅20 μm, or even better, as discussed later. Therefore, the measured height, (EH)', is (since: δϕ<<1):

$$(EH)' = a\sin(\phi+\delta\phi) \cong EH + a\delta\phi \tag{2}$$

i.e., measured with high accuracy, in the range of 10-20 μm.

Figure 13:
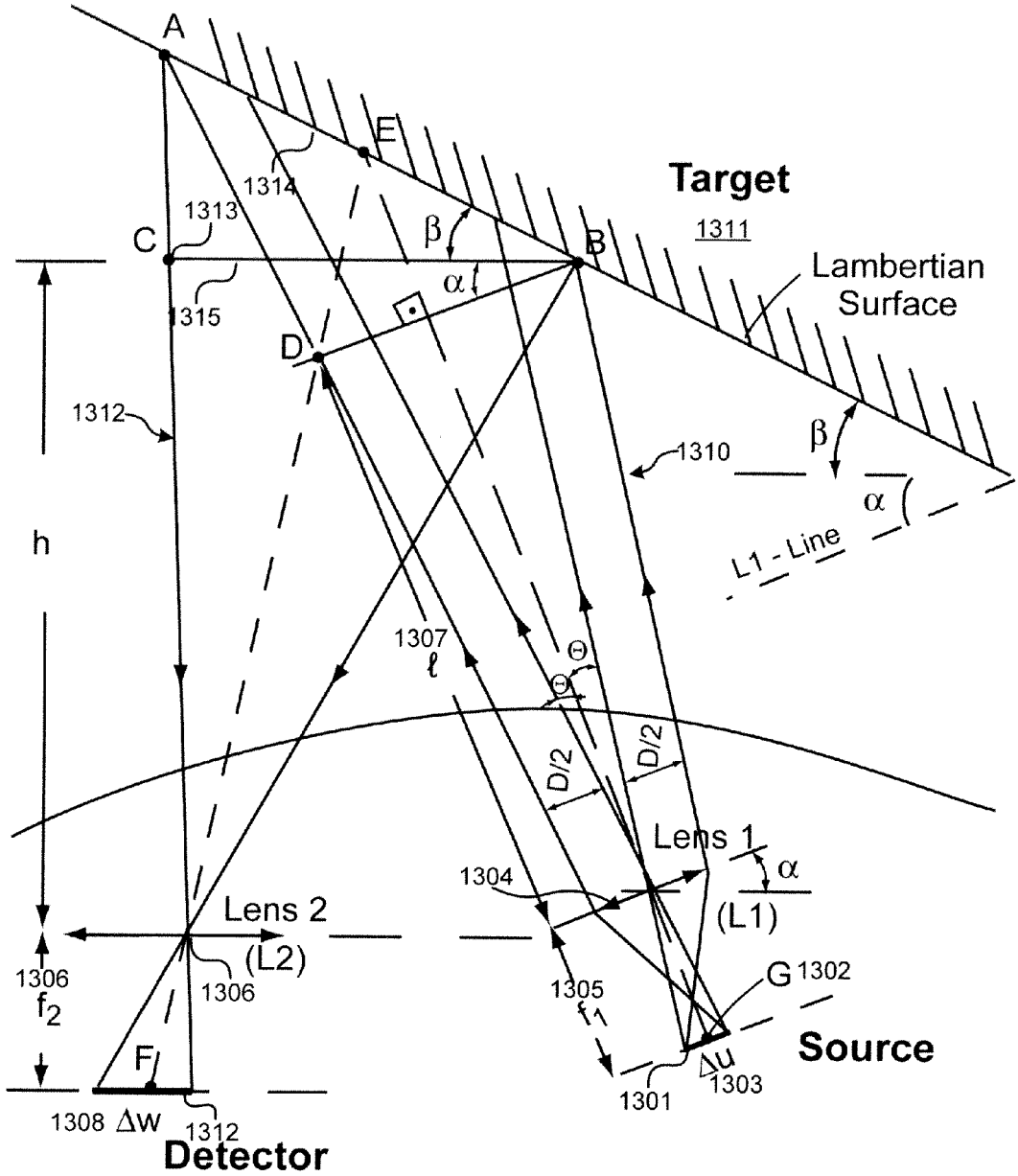
FIG. 13 illustrates use of source contour imaging (SCI) to find the center of gravity of a laser source's strip transversal dimension, implemented in accordance with an embodiment of the invention.

FIG. 13 illustrates use of source contour imaging (SCI) to find the center of gravity of a laser source's strip transversal dimension, implemented in accordance with an embodiment of the invention. As illustrated, a laser source disposed in a sensor body projects a laser beam 1310 to a target 1311. The target 1311 is assumed to be a partially Lambertian surface, for example, a 10% Lambertian surface. A reflected beam 1312 is reflected from the target 1311 and detected at the detector 1312. In this figure, the source strip 1301, with center of gravity, G 1302, and size, Δu 1303, is collimated by lens 1 (L1) 1304, with focal length, $f_1$ 1305, and size, D, while imaging lens (L2) 1306 has dimensions $f_2$ 1307, and $D_2$, respectively. For simplicity, in the illustrated embodiment, we assume $f_1=f_2=f$, and $D_1=D_2=D$. (In other embodiments, these parameters may vary. For example, the $2^{nd}$ lens may be larger to accommodate larger linear pixel area). The size of the source beam at distance-l, is, according to FIG. 13:

$$DB = 2l\Theta + D = \frac{l\cdot\Delta u}{f} + D = \frac{l\cdot\Delta u}{f} + \frac{f}{f\#} \tag{3}$$

Where, for Θ<<1, Θ=Δu/2f, and f#=f/D is so-called f-number of the lens. A typical, easy-to-fabricate (low cost) lens usually has f#≧2. As an example, for f#=2, l=10 m, f=2 cm, and Δu=50 μm, we obtain $$\begin{aligned} DB &= \frac{10\ \text{m}\times 50\ \mu m}{2\ \text{cm}} + \frac{2\ \text{cm}}{2} + \frac{(10^4\ \text{mm})(0.05\ \text{mm})}{20\ \text{mm}} + 1\ \text{cm} = \\ &= 2.5\ \text{cm} + 1\ \text{cm} \\ &= 3.5\ \text{cm} \end{aligned} \tag{4}$$

Eq. (3) can become:

$$DB = \frac{l}{f}\left(\Delta u = \frac{f^2}{l\cdot f\#}\right) \tag{5}$$

where the $2^{nd}$ term does not depend on source's size. This term determines the size of the source's image spot on the target, and accordingly contributes to the power output required of the laser. In order to reduce this term, some embodiments use reduced lens sizes. The distance to the target 1307, l, is predetermined according to the concept of operation (CONOPS), and f#-parameter defines how easy is to produce the lens and will also be typically fixed. Accordingly, the f-parameter frequently has the most latitude for modification. For example, reducing focal length by 2-times, the $2^{nd}$ factor will be reduced 4-times, to 2.5 mm, vs. 2.5 cm value of the $1^{st}$ term.

As illustrated in FIG. 13, the size of source contour image (SCI), Δw 1308, is $$\Delta w = \chi(DB)\frac{f}{h} = \chi\left(\frac{l\cdot\Delta u}{h} + \frac{f^2}{hf\#}\right) \tag{6}$$

where χ is a correction factor, which, in good approximation, assuming angle ACB 1313 close to 90°, is equal to:

$$\chi \cong \frac{\cos\beta}{\cos(\alpha+\beta)} \tag{7}$$

Since, χ≅1, and h≅l, Eq. (6) can be approximated by:

$$\Delta w \cong \Delta u + \frac{f^2}{hf\#} \tag{8}$$

which is approximately constant, assuming Δu, f, f#, and h-parameters fixed. Assuming, as an example, Δu=50 μm, f=2 cm, h=10 m, f#=2, we obtain $$\Delta w = 50\ \mu m + 20\ \mu m + 70\ \mu m \tag{9}$$

Eq. (6) is based on a number of approximations which are well satisfied in the case of low-resolution imaging such as the SCI.

As illustrated in FIG. 13, in some embodiments, SCI is based on the approximate formula that resulting under the assumption that instead of imaging contour area AB 1314, its projection CB 1315 may imaged. Furthermore, a second assumption is that area AB may be imaged, instead of CB (i.e., that we can assume β=0). However, AB 1314 is a part of Lambertian surface of the target 1311, which means that each point of an AB-area reflects spherical waves (not shown) as a response to a collimated incident beam 1310 produced by source 1301 with center of gravity G 1302, and strip's size Δu 1303.

Figure 14:
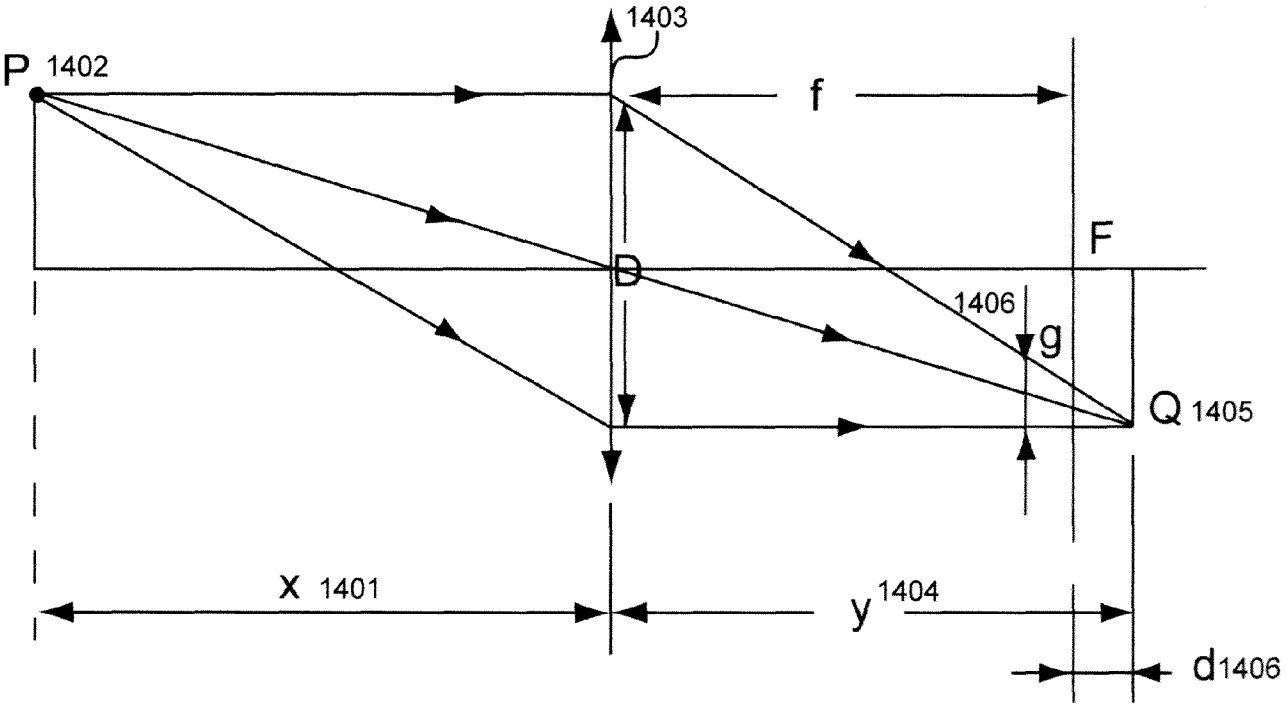
FIG. 14 illustrates an imaging lens geometry.

FIG. 14 illustrates an imaging lens geometry. In order to show that area CB 1313 indeed images (approximately) into an area about Δw's size 1308, consider simple imaging lens 1403 geometry, as in FIG. 14, where the x parameter 1401 is an object point 1402 (P) plane's distance from a lens, while y 1404 is its image (Q) 1405 plane's distance from lens 1403. The image sharpness is determined according to the de-focusing distance, d 1406, and de-focusing spot, g 1407, with respect to focal plane. The lens image equation, is $$\frac{1}{x} + \frac{1}{y} = \frac{1}{f};\ \frac{1}{y} = \frac{x-f}{x\cdot f} \tag{10}$$

The de-focusing distance, d is (x>>f), $$d = y - f = \frac{xf}{x-f} - f = \frac{f^2}{x-f} \cong \frac{f^2}{x} \tag{11}$$

and, using trigonometric sine theorem, we obtain $$\frac{D}{y} = \frac{g}{d} \Rightarrow g = \frac{d\cdot D}{y} \cong \frac{d\cdot D}{f} = \frac{d}{f\#} \tag{12}$$

Using Eq. (11) and the geometry of FIG. 14 (x=h), we obtain $$g = \frac{d}{f\#} = \frac{f^2}{f\#h} \tag{13}$$

For example, for f=1 cm, and f#=2, and h=10 m, we obtain g=5 μm; i.e., 10% of source's strip size (50 μm).

In order to verify the $2^{nd}$ assumption that we can approximate position of AB-contour by its CB-projection, the influence of AC-distance (Δd) on image dis-location may be analyzed. In such a case, instead of de-focusing distance, d, we introduce new de-focusing distance, d', in the form:

$$\begin{aligned} d' &= \frac{f^2}{h+\Delta h} \\ &= \frac{f^2(h-\Delta h)}{h^2-(\Delta h)^2} \\ &\cong \frac{f^2(h-\Delta h)}{h^2} \\ &= \frac{f^2}{h} - \frac{f^2(\Delta h)}{h^2} \\ &= d - d\left(\frac{\Delta h}{h}\right) \end{aligned} \tag{14}$$

i.e., this dis-location is (Δh/h)-times smaller than d-distance, which is equal to $f^2/h$. For example, for f=1 cm, and h=10 m, we obtain d=10 μm, and (Δh/h)=(AC/h)≅2 cm/10 m=0.002; i.e., in very good approximation: d'=d, and treating the imaging of contour AB as equivalent to imaging of its projection, CB results in reasonable imaging.

Figure 15:
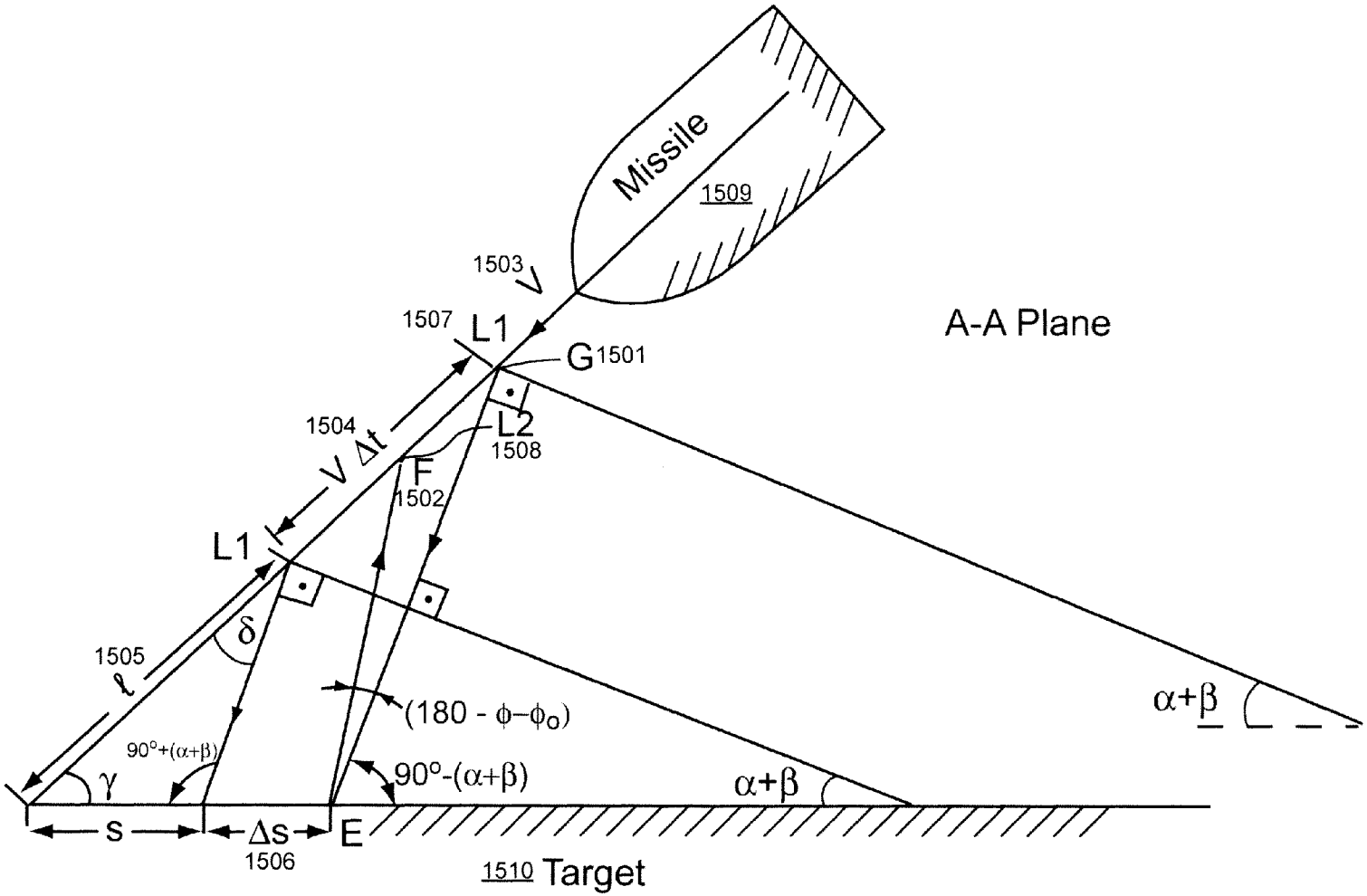
FIG. 15 illustrates a method of detecting target size implemented in accordance with an embodiment of the invention.

FIG. 15 illustrates a method of detecting target size implemented in accordance with an embodiment of the invention. FIG. 15 uses the same basic geometry and symbols as FIG. 13, for the sake of clarity. Points G 1501 and F 1502 are centers of lenses L1 1507 and L2 1508, respectively, and vector $\vec{v}$ 1503 represents the velocity of missile 1509 in the vicinity of the target 1510. During time duration Δt 1504, missile 1509 traverses distance vΔt. The angles α and β are equivalent to those in FIG. 13. Angles φ and $\phi_o$ are equivalent to those in FIG. 12. Distance l 1505 is within the predetermined distance range for triggering the missile 1509 to explode. For example, distance l 1505 may be an optimal predetermined target distance, and the predetermined distance range may be a range around distance l 1065 where target sensing is possible. At an initial distance, due to the detection system geometry or laser power, the target 1510 become initially detectable. This allows detection of the target 1510 through a Δs-target area 1506, during time, Δt 1504.

From the sine theorem, we have:

$$\frac{l}{\sin(90^\circ+\alpha+\beta)} = \frac{s}{\sin\delta} \tag{15}$$

where γ is angle between missile speed vector, $\vec{v}$ 1503, and the surface of target 1510, while: sin(90°+α+β)=cos(α+β), and the angle, δ, is $$\delta=180°-\gamma-(90°+\alpha+\beta)=90°-(\gamma+\alpha+\beta) \tag{15}$$

thus, Eq. (15) becomes:

$$\frac{l}{\cos(\alpha+\beta)}=\frac{s}{\cos(\gamma+\alpha+\beta)}. \tag{17}$$

According to Thales' Theorem, we have:

$$\frac{v\Delta t}{l}=\frac{\Delta s}{s}. \tag{18}$$

Substituting Eq. (17) into Eq. (18), we obtain $$\Delta s=v\Delta t\frac{s}{l}=v\Delta t\frac{\cos(\gamma+\alpha+\beta)}{\cos(\alpha+\beta)}=\chi_o v\Delta t. \tag{19}$$

For typical applications, γ-angle is close to 90°, while angles α and β are rather small (and angle δ is small). For example, assuming δ=10°; so, γ+α+β=80°, and α+β=20°, we obtain $\chi_o$=0.18, and, for vΔt=10 m, we obtain $$\Delta s=(0.18)(10\text{ m})=1.8\text{ m}. \tag{20}$$

In a typical application, assuming v·Δt=10 m, and v=400 m/sec, for example, we obtain $$\Delta t=\frac{10\text{ m}}{400\text{ m/sec}}=0025\text{ sec}\quad=25\text{ m sec}. \tag{21}$$

This illustrates typical times, Δt, that are available for target sensing. Therefore, in this example, the detection system can determine that the detected target has at least one dimension greater than or equal to 1.8 m size. This provide a counter-countermeasure (CCM) against obstacles smaller than 1.5 m. In order to increase the CCM power, we should increase $\chi_o$-factor by increasing angle, δ. For example, if the missile 1509 has a more inclined direction, by reducing angle, γ, Δs 1506 increases. For example, for δ=20°, and the same other parameters, we obtain $\chi_o$=0.36, and Δs=3.6 m.

In embodiments utilizing a photodetector having a major axis (for example, photodetectors 447 and 449 of FIG. 4), the distance Δs 1506 may be increased by positioning the major axis in the plane of FIG. 15. In a further embodiment, the photodetector comprises a quadratic pixel array. In this embodiment, control logic is provided in the detection system to automatically select the (virtual) linear pixel array with minimum size. In still further embodiments, a plurality of photodetectors is positioned radially around the detector system, for example as described in FIG. 7. In these embodiments, control logic may be configured to select the sensor which is located most closely to the plane of FIG. 15 for target detection.

Figure 16:
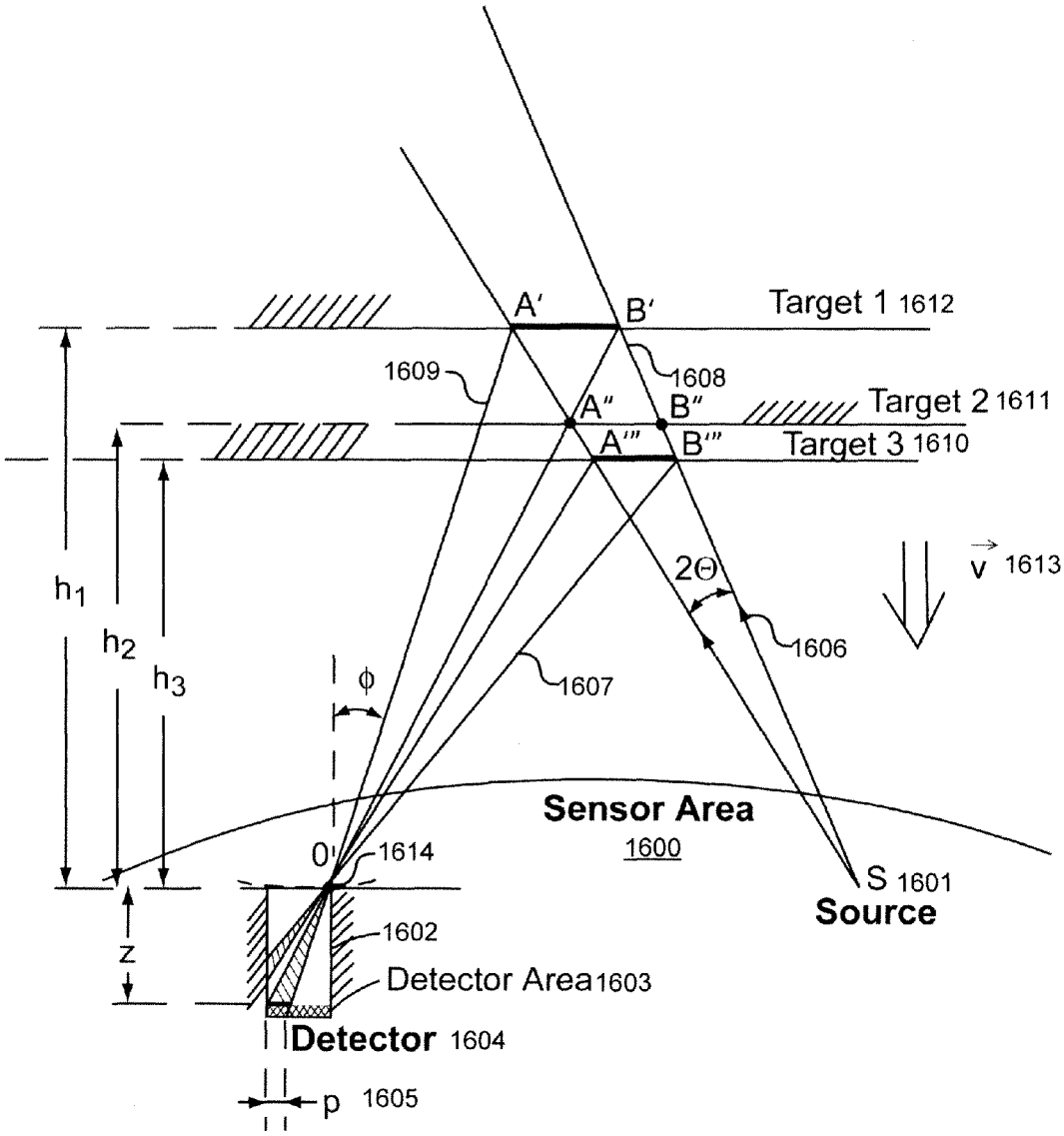
FIG. 16 illustrates an embodiment of the invention utilizing vignetting for determining if a target is within a predetermined distance range.

FIG. 16 illustrates an embodiment of the invention utilizing vignetting for determining if a target is within a predetermined distance range. In the illustrated embodiment, optical proximity sensor 1600 emits a light beam 1606 from a light source 1601. The sensor 1600 is coupled to a projectile that is moving towards a target. In the sensor's frame of reference, this results in the target moving towards the sensor 1600 with velocity $\vec{v}$ 1613. For example, in the illustrated embodiment, the target moves from a first position 1612, to a second position 1611, to a third position 1610. The sensor 1600 include a detector 1604. The detector 1604 comprises a photodetector 1603 positioned behind an aperture 1614. In the illustrated embodiment, lenses are foregone, and target imaging proceeds with vignetting or shadowing, alone. For example, when the target is at the third position 1610 at distance $h_3$ from the sensor 1600, the reflected light beam 1607 strikes a wall 1602 of the detector 1604 rather than the photodetector 1603. In contrast, the entire reflected beam 1609 from the first target position 1612 impinges the photodetector 1603. As the Figure illustrates, there is a target position 1612 where the edge of the imaged beam 1605 abuts the edge of the photodetector 1603. As the sensor 1600 moves closer to the target, less and less of the beam will impinge the photodetector 1063, until the beam no longer impinges the photodetector 1603 (for example, at position 1610). Similarly, as the sensor 1600 first comes within range of the target, the beam will partially impinge on the photodetector 1603. The beam will then traverse the detector until it fully strikes the photodetector 1603. Accordingly, as the sensor traverses the predetermined distance range, the signal from the photodetector will first rise, then plateau, then begin to fall. In an embodiment of the invention, the specific detonation distance within this range is chosen when the signal begins to fall, or has fallen to some predetermined level (for example, 50% of maximum). Accordingly, the time in which the signal increases and plateaus may be used for target verification, while still supporting a relatively precise targeting distance for detonation.

Figure 17:
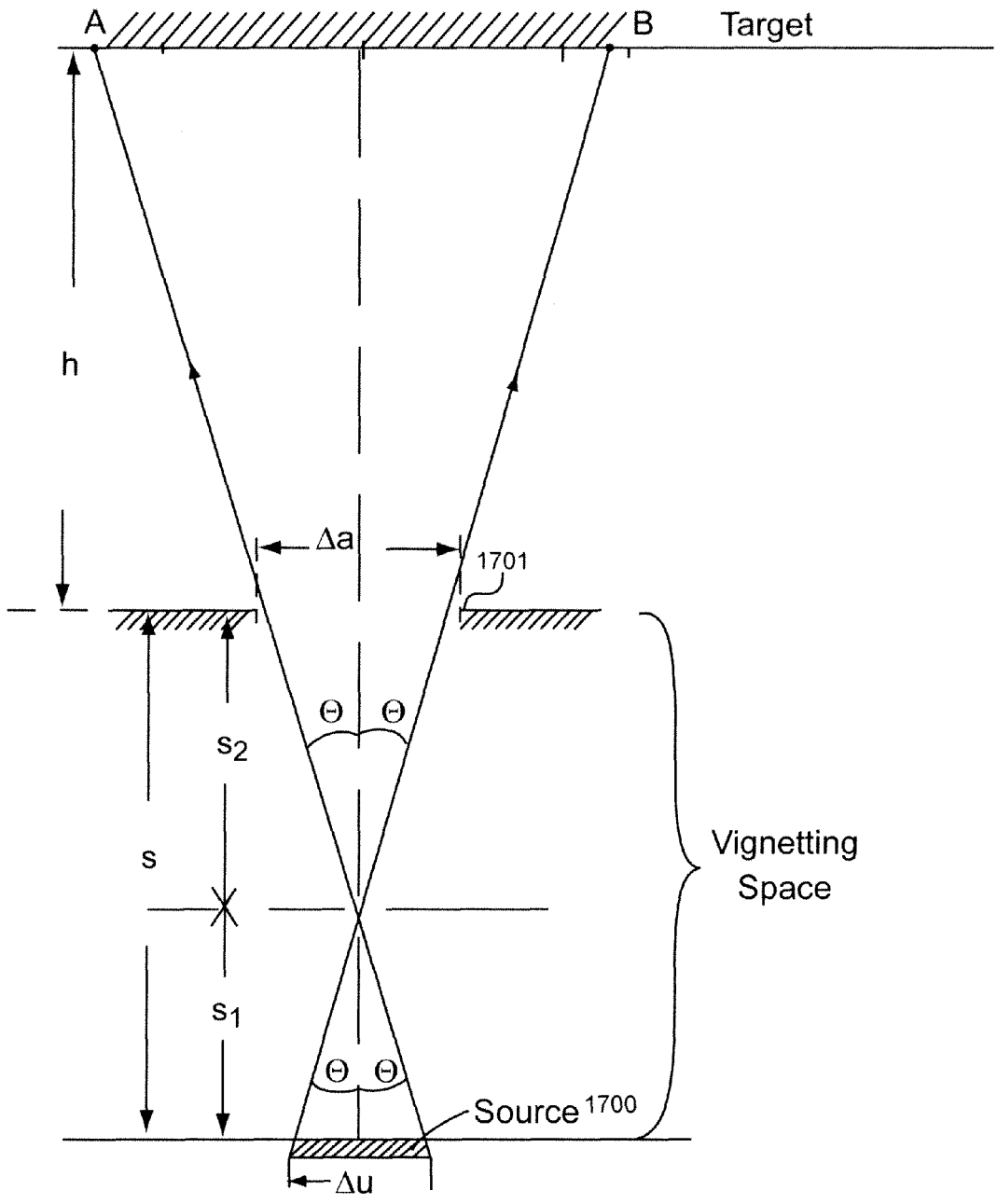
FIG. 17 illustrates a lensless light source for use in an optical proximity sensor implemented in accordance with an embodiment of the invention.

FIG. 17 illustrates a lensless light source for use in an optical proximity sensor implemented in accordance with an embodiment of the invention. In some embodiment, the light source 1700 can also be vignetted. FIG. 17 illustrates variables for quantitative analysis purposes. Variables include vignetting opening 1701 size, Δa, source size, Δu, vignetting length, s, and resulting source beam divergence, 2Θ. Then, the source beam size, AB, at the target distance, h, is $$AB=2\Theta(h+s_2)\approx 2\Theta h \tag{31}$$

Since, $s_2 \ll h$, as in FIG. 17. From this figure, we have;

$$\frac{\Delta a}{s_2}=\frac{\Delta u}{s_1},\text{ and } s_1+s_1=s \tag{32}$$

Solving Eqs. (32), we obtain $$s_1=\frac{s}{1+k},\ s_2=\frac{sk}{1+k} \tag{33}$$

where k is called vignetting coefficient, being the ratio of vignetting opening size to source size:

$$k=\frac{\Delta a}{\Delta u} \tag{34}$$

usually k≧1 for practical reasons. For example, for Δu=50 μm (for edge-emitter strip size), Δa=100 μm can be easy achieved; then, k=2. Substituting Eq. (33) into Eq. (31), we obtain $$AB = \frac{h\Delta u}{s}(1+k) \tag{35}$$

For example, for k=2, Δu=50 μm (then, Δa=100 μm), s=5 cm, and h=10 m, we obtain AB=3 cm.

Figure 18:
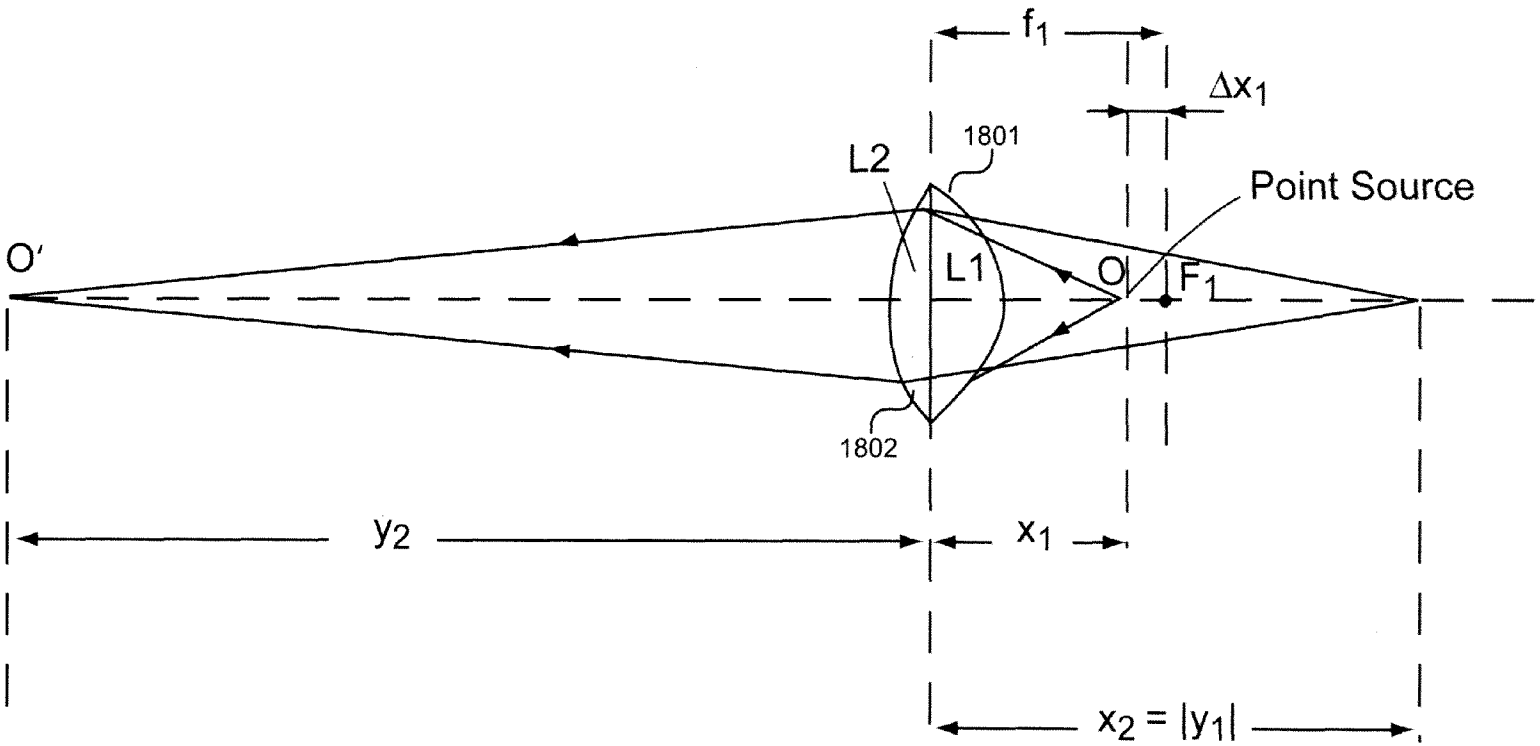
FIG. 18 illustrates a dual lens geometry.

In further embodiment, the light source may be imaged directly onto the target area. A Lambertian target surface backscatters the source beam into detector area where a second imaging system is provided, resulting in dual imaging, or cascade imaging. FIG. 18 illustrates variables of a lens system for quantitative analysis purposes. In various embodiments, the viewing beam imaging can be provided with single-lens or dual-lens system. Consider imaging equation in the form: $x^{-1}+y^{-1}=f^{-1}$, where x and y are distance of object plane and image plane from lens and f is focal length. Then, in order to obtain single lens imaging with short x-value (for example, a few cm) and long y-value (for example, y≅10 m), we need to place the source close behind the focus, at distance, Δx;

$$\Delta x = x - f = \frac{xf}{y-f} - f = \frac{f^2}{y-f} \cong \frac{f^2}{y} \tag{36}$$

For example, for f=2 cm and y=10 m, we obtain Δx=40 μm which is very small value for precise adjustment. The positioning requirements can be made less demanding by utilizing a dual-lens imaging system.

FIG. 18 illustrates a dual lens geometry. Two convex lenses, 1801 and 1802, are provided for source (viewing) beam imaging, with focal lengths $f_1$ and $f_2$, including imaging equation for $1^{st}$ lens ($x_1$, $y_1$, $f_1$) and imaging equation for the $2^{nd}$ lens ($x_2$, $y_2$, $f_2$). A point source, O, is included, for simplicity, with its image, O'. In the illustration, the source is placed at the front of the $1^{st}$ focus, $F_1$, with $\Delta x_1$ distance from the focal plane. Then, the $1^{st}$ image is imaginary, with negative distance: $y_1=-|y_1|$, where | . . . | is module operation, and the $1^{st}$ image equation has the form:

$$\frac{1}{x_1} - \frac{1}{|y_1|} = \frac{1}{f_1} \Rightarrow x_1 = \frac{f_1|y_1|}{f_1+|y_1|} \tag{37}$$

and, $$\Delta x_1 = f_1 - x_1 = \frac{f_1^2}{f_1+|y_1|} \cong \frac{f_1^2}{|y_1|} \tag{38}$$

For $|y_1|>>f_1$. For example, for $f_1$=3 cm and $\Delta x_1$=0.5 mm, we obtain $|y_1|$=1.8 m. A 0.5 mm adjustment may be more manageable than a 40 μm adjustment, as for single-lens system. Now, we assume the $1^{st}$ imaginary image to be the $2^{nd}$ real object distance; $x_2=|y_1|$. Therefore, the required $2^{nd}$ lens focal length, $f_2$, is $$f_2 = \frac{|y_1|y_2}{|y_1|+y_2} = \frac{(1.8\text{ m})(10\text{ m})}{1.8\text{ m}+10\text{ m}} = 1.5\text{ m} \tag{39}$$

and, $$f_2<y_2, f_2<|y_1|=1.8\text{ m} \tag{40}$$

as expected. In this case, the system magnification, is $$M = \frac{y_2}{x_1} \cong \frac{y_2}{f_1} = \frac{10\text{ m}}{2\text{ cm}} = 333 \tag{41}$$

and the final image size for edge-emitter strip size of 50 μm will be: (333)(50 μm)=1.66 cm. For this dual-lens system, by adding two image equations together, we obtain the following summary image equation:

$$\frac{1}{x_1} + \frac{1}{y_2} = \frac{1}{f_0};\ \frac{1}{f_0} = \frac{1}{f_1} + \frac{1}{f_2} \tag{42}$$

where $f_0$ is dual-lens system focal length.

In typical embodiments, the lens curvature radius, R, is larger than the half of the lens size, D; R>D/2. However, for a plano-convex lens, we have: $f^{-1}=(n-1)R^{-1}$, where n is refractive index of the lens material (n≅1.55); thus, approximately, we have: f≅2R, while for double-convex lens: f≅R. Also, for cheaply and easily made lenses lenses, the f#-ratio parameter (f#=f/D) will typically be larger than 2: f#>2. Using this relation, for plano-convex lens we obtain R>D, and for double convex: R>2D; i.e., in both cases: R>D/2, as it should be in order to satisfy system compactness.

Potential sources of interference and false alai ins include natural and common artificial light sources, such as lightning, solar illumination, traffic lighting, airport lighting, etc . . . In some embodiments, protection from these false alarm sources is provided by applying narrow wavelength filtering centered around the laser diode wavelength, $\lambda_o$. In some embodiments, dispersive devices (prisms, gratings, holograms), or optical filters, are used. Interference filters, especially reflective ones, have higher filtering power (i.e., high rejection of unwanted spectrum while high acceptance of source spectrum) at the expense of angular wavelength dispersion. In contrast, absorption filters have lower filtering power while avoiding angular wavelength dispersion. Dispersive devices such as gratings are based on grating wavelength dispersion. Among them, volume (Bragg) holographic gratings have the advantage of selecting only one diffraction first order (instead of two, as in the case of thin gratings); thus, increasing filtering power by at least a factor of two.

Reflection interference filters have higher filtering power than transmission ones due to the fact that it is easier to reflect a narrower spectrum than a broader one. For example, a Lippmann reflection filter comprises a plurality of interference layers that are parallel to the surface. Such filter can be made either holographically (in which case, the refractive index modulation is sinusoidal), or by thin-film-coating (in which case, the refractive index modulation is quadratic).

From coupled-wave theory, in order to obtain 99%-diffractive efficiency, the following approximate condition has to be satisfied:

$$\frac{\Delta n \cdot T}{\lambda_o'} = 1 \tag{43}$$

where $\Delta n$ is refractive index modulation, and $\lambda_o'$ is central wavelength in the medium, with refractive index, n. Since, $\Lambda=\lambda_o/2n$, $\Delta n/n$ and $\Delta n=\lambda/nT$, we obtain $$\frac{\Delta\lambda}{\lambda} = \frac{2}{nN} \tag{44}$$

where $N=T/\Lambda$ is the number of periods, or number of interference layers. For typical polymeric (plastic) medium, we have n=1.55; so, Eq. (44) becomes $$\frac{\Delta\lambda}{\lambda} = 1.29\frac{1}{N}. \tag{45}$$

For example, for $\lambda_o$=600 nm, $\Delta\lambda$=10 nm, $\Delta\lambda/\lambda=1/60=0.0167$, and N=77. Accordingly, in order to obtain higher filtering power, the number of interference layers should be larger.

For slanted incidence angle, $\Theta'$, in the medium (where for $\Theta'=0$, we have normal incidence), the Bragg wavelength, $\lambda_o$, is shifted to shorter values (so-called blue shift):

$$\lambda=\lambda_o' \cos\Theta' \tag{46}$$

therefore, relative blue-shift value, is $$\frac{\delta\lambda}{\lambda_o} = 1 - \cos\Theta'. \tag{47}$$

Using Snell's law: $\sin\Theta=n\sin\Theta'$, we obtain for $\Theta'<<1$, $$\Theta = \arcsin\left(n\sqrt{\frac{2\delta\lambda}{\lambda_o}}\right). \tag{48}$$

For example, for $\delta\lambda$=10 nm, $\lambda$=600 nm, n=1.55, we obtain $\Theta$=16.4°. Therefore, the total spectral width is: $\Delta\lambda+\delta\lambda$; i.e., about 20 nm in this example.

Figure 19:
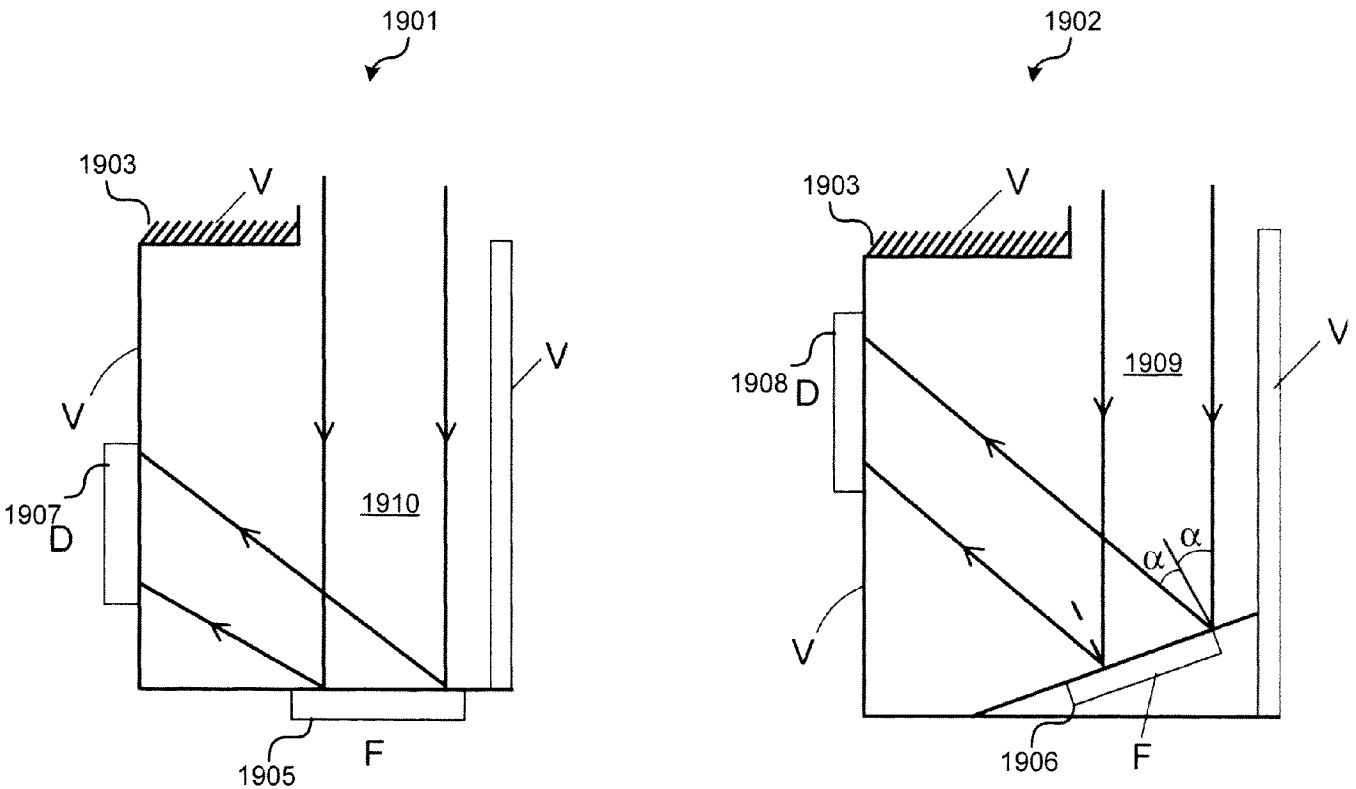
FIG. 19 illustrates two detector geometries for use with reflection filters implemented in accordance with embodiments of the invention.

FIG. 19 illustrates two detector geometries for use with reflection filters implemented in accordance with embodiments of the invention. In detector 1902, an aperture is formed in a detector housing 1903. In some embodiments, imaging is based on vignetting entirely. In other embodiments, lens or mirror based imaging systems may be combined with the aperture. The detector is configured to receive a beam 1910 reflected from a target. A reflective filter 1905 is configured to reflect only wavelengths near the wavelength or wavelengths of the laser light source or sources used in the proximity detector. Accordingly filter 1905 filters out likely spurious light sources, reducing the probability of a false alarm. Filter 1905 is configured to reflect light at an angle to detector 1907. For example, such non-Lippman slanted filters may be produced using holographic techniques. In detector 1902, a Lippman filter 1906 is disposed at an angle with respect to the aperture, allowing beam 1909 to be filtered and reflected to detector 1908 as illustrated.

Another potential source of false alarms is from environmental conditions. For example, optical signals can be significantly distorted, attenuated, scattered, or disrupted by harsh environmental conditions such as: rain, snow, fog, smog, high temperature gradient, humidity, water droplets, aerosol droplets, etc. In some embodiments of the invention, in order to minimize the false alarm probability against these environmental causes, we maximize laser diode conversion efficiency and also maximize focusing power of optical system. This is because, even in proximity distances (10 m, or less), beam transmission can be significantly reduced by transmission medium (air) attenuation, especially in the case of smog, fog, and aerosol particles, for example. For strong beam attenuation of 1 dB/m, the attenuation at 10 m-distance is 90%. Also, optical window transparency can be significantly reduced due to dirt, water particles, fatty acids, etc. In some embodiments, the use of a hygroscopic window material protects against the latter factor.

Figure 20:
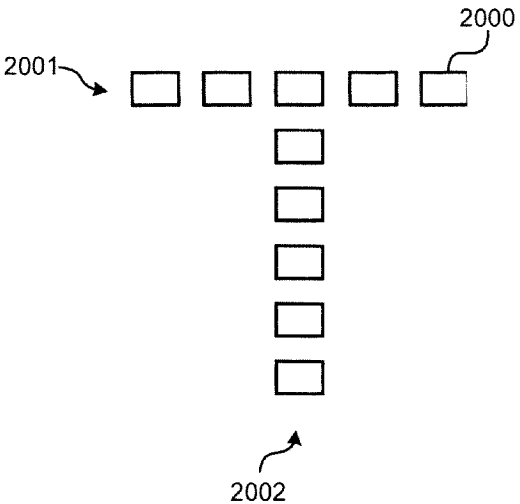
FIG. 20 illustrates a laser diode array having a spatial signature implemented in accordance with an embodiment of the invention.

In some embodiments of the invention, high conversion efficiency (ratio of optical power to electrical power) can be obtained using VCSEL-arrays. In further embodiments, the VCSEL arrays may be arranged in a spatial signature pattern, further increasing resistance to false alarms. For example, FIG. 20 illustrates a VCSEL 2000 array arranged in a "T"-shaped distribution. Arranging the laser diodes into a desired spatial distribution avoids signature masks which would block some illumination; thus, reducing optical power, or effective conversion efficiency, $\eta_{eff}$, that is defined, as:

$$\eta_{eff}=\eta_1\cdot\eta_2 \tag{49}$$

where $\eta_1$ is the common conversion efficiency, and $\eta_2$—is masking efficiency.

In further embodiments, beam focusing lens source geometries such as projection imaging and detection imaging, as discussed above, provide further protection from beam attenuation. To further reduce attenuation, system magnification M, defined by Eq. (41), is reduced by increasing $f_1$-value. In order to still preserve compactness, at least, in vertical dimension, in some embodiments, horizontal dimension is increased by using mirrors or prisms to provide a periscopic system.

High temperature gradient (~100° C.) can cause strong material expansion; thus, reducing mechanical stability of optical system. In some embodiments, the effects of temperature gradients are reduced. The temperature gradient, $\Delta T$, between $T_1$-temperature at high altitudes (e.g., −10° C.), and $T_2$-temperature of air due to air friction against missile body (e.g., +80° C.) creates expansion, $\Delta l$, of the material, according to the following formula ($\Delta T=T_2-T_1$):

$$\frac{\Delta\ell}{\ell} = \alpha\cdot\Delta T \tag{50}$$

where $\alpha$ is linear expansion coefficient in $10^{-6}$ (° C.)$^{-1}$ units. Typical $\alpha$-values are: Al—17, steel—11, copper—17, glass—9, glass (pyrex)—3.2, and fused quartz—0.5. For example, for $\alpha=10^{-6}$ (° C.)$^{-1}$, and $\Delta T$=100° C., we obtain $\Delta l/l=10^{-4}$, and for l=1 cm, $\Delta l$=1 μm. This is a small value but it can cause problems for metal-glass interfaces. For example, for steel/quartz interface: $\Delta\alpha=(11-0.5)10^{-6}$ (° C.$^{-1}$), and for $\Delta T$=100° C., and l=1 cm, we obtain $\delta(\Delta l)=(11-0.5)\ 10^{-4}$ cm≅$10^{-3}$ cm=10 μm which is larger value for micro-mechanic architectures (1 mill=25.4 μm, which is approximate thickness of human hair). In some embodiments, index-matching architectures are implemented to avoid such large $\Delta\alpha$-values at mechanical interfaces.

Figure 21:
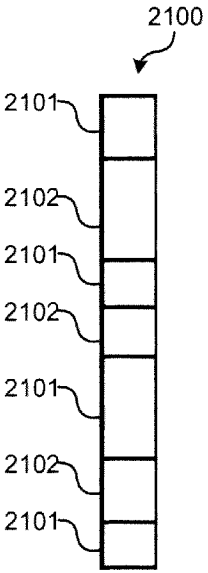
FIG. 21 illustrates a laser diode mask for implementing a spatial signature in accordance with an embodiment of the invention.

Additionally, attempts at active countermeasures may be utilized by adversaries. In some embodiments, anti-countermeasure techniques are employed to reduce false alarms caused by countermeasures. Examples include the use of spatial and temporal signatures. One such spatial signature has been illustrated in FIG. 20, where two VCSEL linear arrays 2001 and 2002, forming the shape of letter "T", have been used. In other embodiments, other spatial distributions of light sources may be used to produce a spatial signature for the optical proximity fuze. Such spatial signatures, in order to be recognized, has to be imaged at the detector space by using a 2D photodetector array. In other embodiments, masks may be used to provide a spatial signature. For example, FIG. 21 illustrates a mask applied to an edge emitting laser source 2100. Masked areas 2101 are blocked from emitting light, while unmasked areas 2102 are allowed to emit light.

Figure 22:
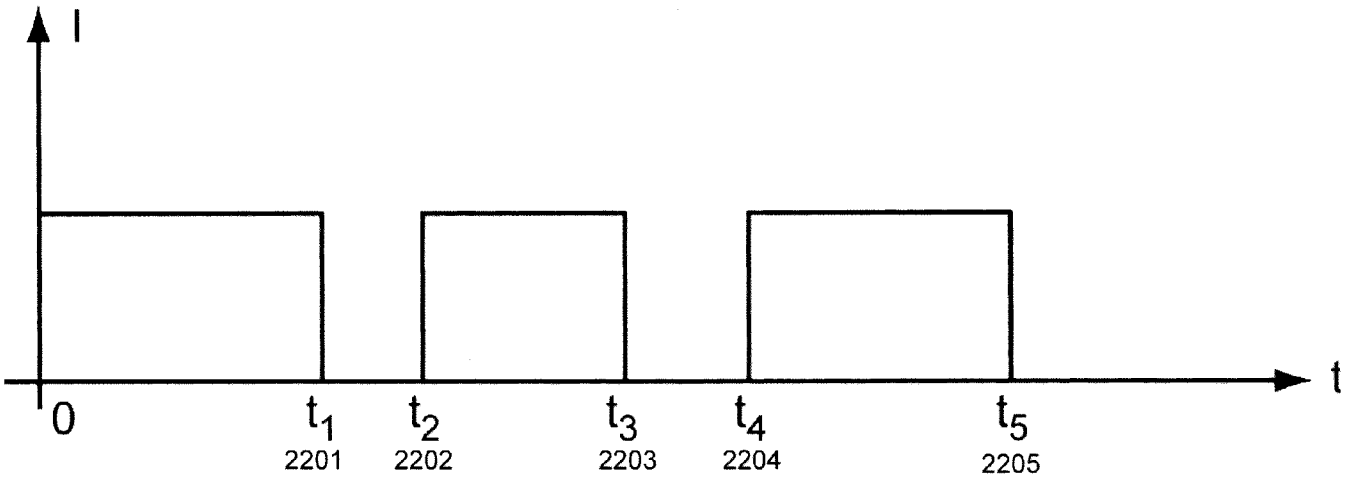
FIG. 22 illustrates a laser light signal with pulse length modulation implemented in accordance with an embodiment of the invention.

In further embodiments, pulse length coding may be used to provide temporal signatures for anti-countermeasures. FIG. 22 illustrates such pulse length modulation. In some embodiments, matching a pre-determined pulse length code may be used to for anti-countermeasures. For example, the detection system may be configured to verify that the sequence indexed by k of pulse lengths, $t_{2ki+1}$-$t_{2k}$, matches a predetermined sequence. In other embodiments, the detection system may be configured to verify that the sequence of start and end times for the pulses matches a predetermined sequence. For example, in FIG. 22, this temporal locations of zero points: $t_1$ 2201, $t_2$ 2202, $t_3$ 2203, $t_4$ 2204, $t_5$ 2205 are presented. These zero points may be compared by the detector against a predetermined sequence to verify target accuracy.

In some embodiments, methods for edge detection, both spatially or temporally, are applied to assist in the use of spatial or temporal signatures. In order to improve edge recognition in both spatial and temporal domain, in some embodiments, a) de-convolution or b) novelty filtering is applied to received optical signals.

De-convolution can be applied to any spatial or temporal imaging. Spatial imaging is usually 2D, while temporal imaging is usually 1D. Considering, for simplicity, 1D spatial domain, the space-invariant imaging operation can be presented as (assuming M=1):

$$I_i(x)=\int h(x-x')I_o(x)dx \tag{51}$$

where $I_i$ and $I_o$ are image and object optical intensities, respectively, while h(x) is so-called Point-Spread-Function (PSF), and its Fourier transform is transfer function, $\hat{H}(f_x)$ in the form:

$$\hat{H}(f_x)=\hat{F}\{I_i(x)\}=\int_{-\infty}^{+\infty} I_i(x)\exp(-j2\pi f_x\cdot x)\,dx \tag{52}$$

where $f_x$ is spatial frequency in number of lines per mm while $\hat{H}(f_x)$ is generally complex. Since, Eq. (51) is convolution of h(x) and $I_o(x)$; then, its Fourier transform, is $$\hat{I}_i(f_x)=\hat{H}(f_x)\hat{I}_o(f_x) \tag{53}$$

thus, $$\hat{I}_o(f_x)=\hat{H}^{-1}(f_x)\hat{I}_i(f_x) \tag{54}$$

and $I_o(x)$ can be found by de-convolution operation; i.e., by applying Eq. (54) and inverse Fourier transform of $\hat{I}_o(f_x)$:

$$I_o(x)=\hat{F}^{-1}\{\hat{I}_o(f_x)\}=\int_{-\infty}^{+\infty}\hat{I}_O(f_x)\exp(j2\pi f_x\cdot x)\,d\,fx. \tag{55}$$

Such operation is computationally manageable if $\hat{H}$-function does not have zero values, which is typical the case for such optical operations as described here. Therefore, even if image function $I_i(x)$ is distorted by backscattering process, and by de-focusing, it can still be restored for imaging purposes.

Figure 23:
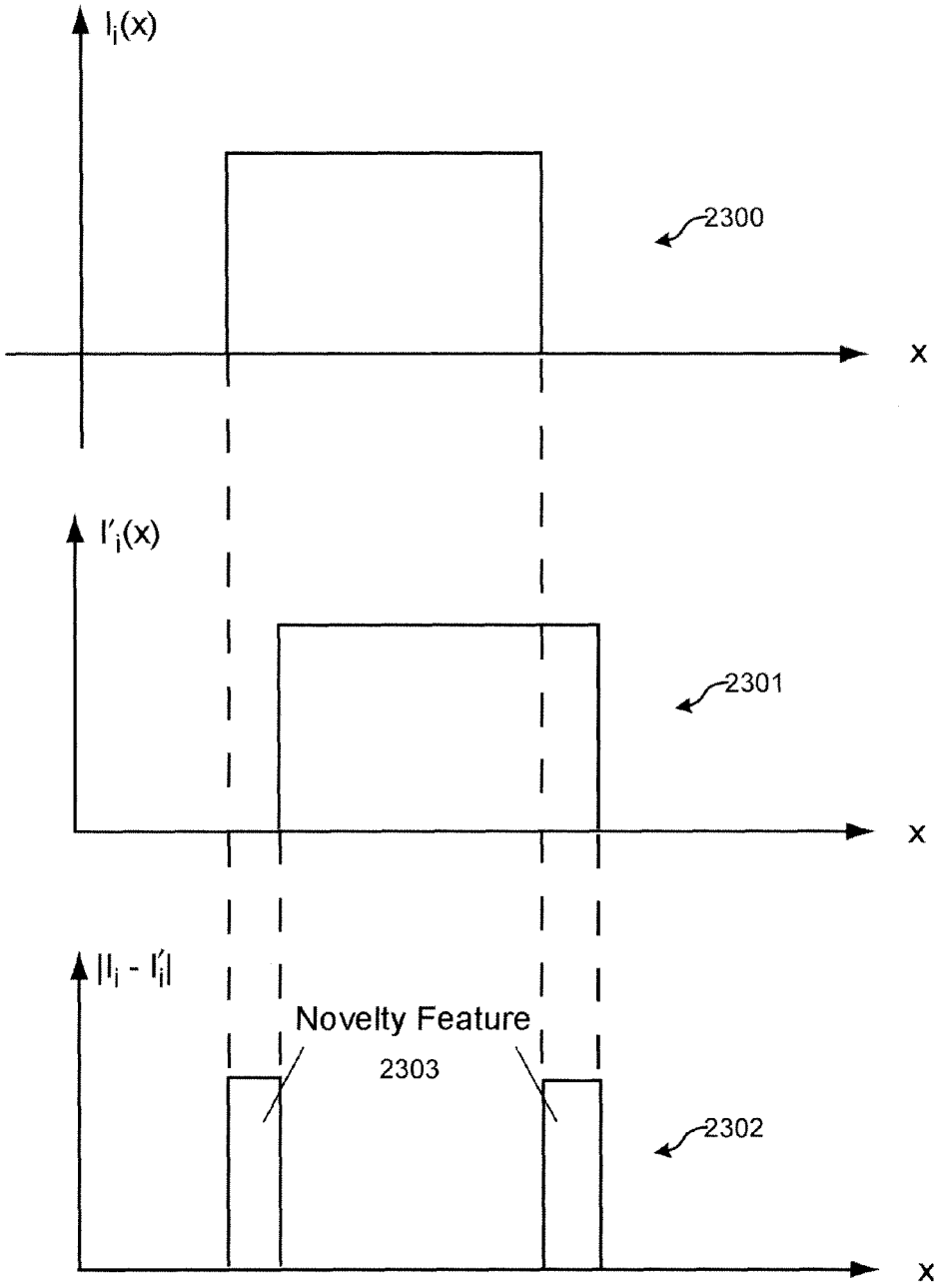
FIG. 23 illustrates a novelty filtering operation for edge detection implemented in accordance with an embodiment of the invention.

Novelty filtering is an electronic operation applied for spatial imaging purposes. It can be applied for such spatial signatures as VCSEL array pattern because each single VCSEL area has four spatial edges. Therefore, if we shift, in electronic domain, the VCSEL array image, by fraction of single VCSEL area and subtract un-shifted and shifted-images in spatial domain, we obtain novelty signals at the edges, as shown in 1D geometry in FIG. 23. As illustrated in FIG. 23, novelty filtering comprises determining a first spatial signature 2300 and shifting the spatial signature in the spatial domain to determine a second spatial signature 2301. Subtracting the two images 2300 and 2301 results in a set 2302 of novelty feature 2303 that may be used for edge detection.

Figure 24B:
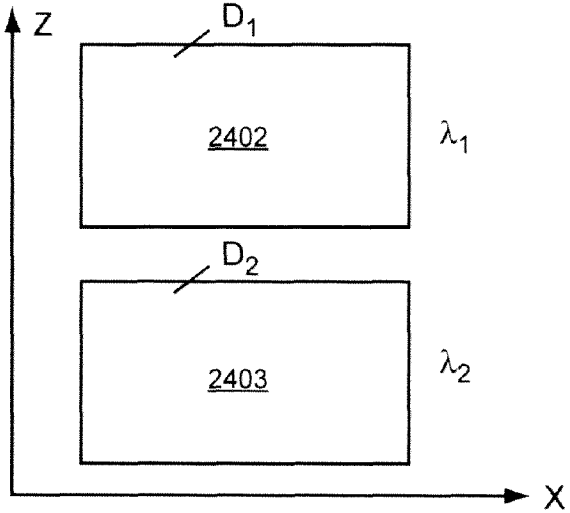
FIG. 24 illustrates multi-wavelength light source and detection implemented in accordance with an embodiment of the invention.
Figure 24A:
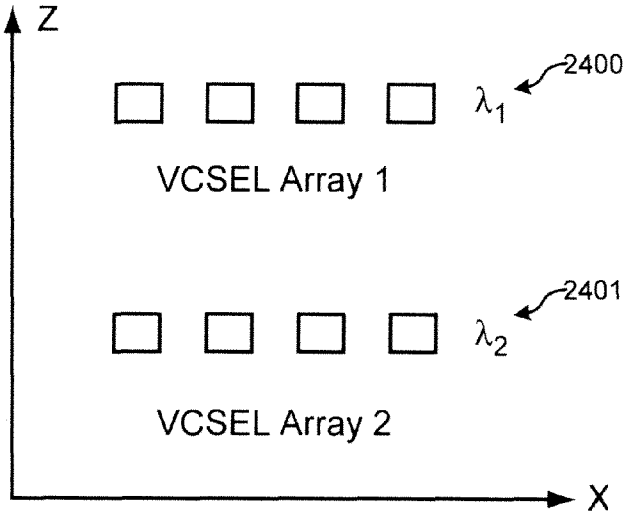

FIG. 24 illustrates multi-wavelength light source and detection implemented in accordance with an embodiment of the invention. FIG. 24A illustrates the light source in the source plane, while FIG. 24B illustrates the detector plane. In this Figure, the axes are as labeled with respect to the plane of FIG. 13 being the (X,Y)-plane. In the illustrated embodiment, two light sources 2400 and 2401, such as VCSEL arrays are disposed in (X, Z)-plane, and emit two wavelengths, $\lambda_1$ and $\lambda_2$, respectively. In the illustrated embodiment, use of spherical lenses (not cylindrical lenses) in order to image 2D source plane into the 2D detector plane. The detectors $D_1$ and $D_2$, 2402 and 2403, are covered by narrow wavelength filters, as described above, corresponding to source wavelengths $\lambda_1$ and $\lambda_2$. Assuming $|\lambda_2-\lambda_1|>50$ nm, we can apply narrow filter with $\Delta\lambda_1=\Delta\lambda_2=20$ nm, for example, thus: $\Delta\lambda+\delta\lambda\equiv 30$ nm to achieve good wavelength separation. It is convenient to place both detectors in the same optical system in order to achieve the same imaging operation for both sources. (This is, however, unnecessary.) As a result, we obtain two orthogonal image patterns when we can add any temporal coding for further false alarm reduction.

The precision of temporal edge detection is defined by the False Alarm Rate (FAR), defined in the following way:

$$\overline{FAR}=\frac{1}{2\tau\sqrt{3}}e^{-I_T^2/2I_n^2} \tag{56}$$

where $I_n$ is noise signal (related to optical intensity), $I_T$ is threshold intensity, and $\tau$ is pulse temporal length. Assuming phase (time) accuracy of 1 nsec, the pulse temporal length, $\tau$, can be equal to: 100 nsec=0.1 μsec, for example. In such a case, for optical impact duration of 10 msec, during which the target is being detected, the number of pulses can be: 10 msec/100 nsec=$10^4$ μsec/0.1 μsec=$10^5$, which is sufficiently large number for coding operations. Eq. (56) can be written as:

$$\tau\overline{FAR}=\frac{1}{2\sqrt{3}}=0.29e^{-x^2/2};\ x=\frac{I_T}{I_n} \tag{57}$$

which can be interpreted as a number of false ala signals) per pulse, which is close to BER (bit-error-rate) definition (as a false alarm in the narrow sense) we mean the situation when the noise signal is higher than threshold signal; i.e., decision is made that true signal exists which is not the case). Eq. (57) is tabulated in Table 1 ($x=I_T/I_n$).

TABLE 1

| $I_T/I_n$-Values Versus $\tau\overline{FAR}$ | | | | | |
|---|---|---|---|---|---|
| | $\tau\overline{FAR}$ | | | | |
| | $10^{-2}$ | $10^{-3}$ | $10^{-4}$ | $10^{-5}$ | $10^{-6}$ |
| x | 2.6 | 3.37 | 3.99 | 4.53 | 5.01 |

As the table illustrates, for higher threshold values, $\tau\overline{FAR}$ decreases.

The second threshold probability is probability of detection. $P_d$, defined as probability that summary $I_s+I_n$, is larger than threshold signal, $I_T$; i.e., $$P_d=P(I_s+I_n>I_T). \tag{58}$$

This probability has the form:

$$P_d = P_d(z) = \frac{1}{2}[1 - N(z)] = \frac{1}{2}\left[1 + \mathrm{erf}\left(\frac{z}{\sqrt{2}}\right)\right] \tag{59}$$

where z-parameter is $$z = \left(\frac{I_s}{I_n} - \frac{I_T}{I_n}\right) = (SNR) - x;\ x = \frac{I_T}{I_n} \tag{60}$$

and SNR=$I_s/I_n$ is signal-to-noise ratio, while N(z) and erf(z) are two functions, well-known in error probability theory, as $$N(x) = \frac{1}{\sqrt{2\pi}}\int_{-x}^{x} e^{-t^2/2}\,dt;\ \mathrm{erf}(x) = \frac{2}{\sqrt{\pi}}\int_{o}^{x} e^{-t^2}\,dt. \tag{61}$$

Both are tabulated in almost all tables of integrals, where N(x) is called normal probability integral, while erf(x) is called error function, and: N(x)=erf(x/$\sqrt{2}$). Probability of detection, $P_d$, and normal probability integral are tabulated in Table 2, where z=(SNR)−x (note that z-value in Table 2 is in Gaussian (normal) probability distribution's dispersion, σ, units; i.e., z=1 is equivalent to σ, while z=2, to 2σ, etc.).

TABLE 2

| Probability of Detection as a Function of z = (SNR) − x; x = $I_T/I_n$ | | | | | | | | |
|---|---|---|---|---|---|---|---|---|
| | z | | | | | | | |
| | 0.5 | 1 | 1.5 | 2 | 2.5 | 3 | 3.5 | 4 |
| N(z) | 0.38 | 0.68 | 0.87 | 0.95 | 0.988 | 0.99 | 0.999 | 0.9999 |
| $P_d$ | 0.69 | 0.84 | 0.93 | 0.98 | 0.99 | 0.999 | 0.9997 | 0.99995 |

The signal intensity, $I_s$, is defined by the application and specific components used, as illustrated above, while noise intensity, $I_n$, is defined by detector's (electronic) noise and by optical noise. In the case of semiconductor detectors, the noise is defined by so-called specific detectivity, D*, in the form:

$$D^* = \frac{A^{1/2}\cdot B^{1/2}}{(NEP)}(\text{in cmHz}^{1/2}\cdot W^{-1}) \tag{62}$$

where A is detector area (in $cm^2$), B is detector bandwidth (for periodic pulse signal, B=½τ, where τ is pulse temporal length), and (NEP) is so-called Noise Equivalent Power, while $$I_n = \frac{(NEP)}{A}. \tag{63}$$

For typical quality detectors, $D^*>10^{12}$ $cmHz^{1/2}W^{-1}$. For example, for τ=100 nsec, B=5 MHz, and for $D^*=10^{12}$ $cmHz^{1/2}$ $W^{-1}$, and A=5 mm×5 mm=0.25 $cm^2$, and $$(NEP) = \frac{A^{1/2}B^{1/2}}{D^*} = 10^{-12}(0.5)\sqrt{5}\,10^3 W = 1.12\cdot 10^{-9} W = 1.12nW \tag{64}$$

and $I_n$=(1.12 nW)/0.25 $cm^2$=4.48 nW/$cm^2$.

According to Table 2, with increasing x-parameter, the threshold value, $I_T$, $P_d$ decreases, i.e., the system performance declines. However, with x-parameter increasing, the $\tau\overline{FAR}$ value also decreases; i.e., the system performance increases. Therefore, there is trade-off between those two tendencies, while threshold value, $I_T$, is usually located between $I_n$ and $I_s$-values: $I_n>I_T\leqq I_s$. From Eq. (58), for $I_s=I_T$, z=0, and $P_d(0)$=½, while $P_d(\infty)$=1. Also, $\overline{FAR}$ (0)=1, and $\overline{FAR}$ (∞)=0. Therefore, for ideal system ($I_n$=0); $\overline{FAR}$=0, and $P_d$=1.

Considering both threshold probabilities: $\tau\overline{FAR}$ and $P_d$, and two parameters: (x, z), we have two functional relations: $\tau\overline{FAR}$ (x) and $P_d(z)$, with additional condition: z=(SNR)−x. Therefore, assuming:

1) GIVEN: (SNR)+one probability, we obtain all parameters: (x, z) and remaining probability.
2) GIVEN: both probabilities, we obtain (x, z)-values.
3) GIVEN: k-parameter as fraction: $I_T=kI_s$, k<1+one probability, we obtain all the rest. For example, for known $P_d$-value, we obtain: z=x($k^{-1}$−1); so, we obtain x-parameter value, and then, from Table 1, we obtain $\tau\overline{FAR}$-value.
4) GIVEN: $I_n$, $I_s$⇒ (SNR) and one probability, we obtain all the rest.

For illustration of trade-off between maximization of $P_d$-probability and minimization of $\tau\overline{FAR}$-probability, we consider three examples.

EXAMPLE 1

Assuming (SNR)=5 and $\tau\overline{FAR}=10^{-4}$, we obtain x=3.99, and z≅5−4=1; thus, $P_d(1)$=0.84, from Table 2.

EXAMPLE 2

Assuming the same (SNR)=5 but worse (FAR): $\tau\overline{FAR}=10^{-3}$, we obtain x=3.37 and z=1.63; thus, N(z)=0.8968 and Pd=0.95; i.e., we obtain better $P_d$-value.

From examples (1) and (2) we see that increasing of positive parameter, $P_d$, is at the expense of increasing of negative parameter, $\tau\overline{FAR}$, and vice versa. This trade-off may be improved by increasing the SNR, as shown in example (3).

EXAMPLE 3

Assuming (SNR)=8 and $\tau\overline{FAR}=10^{-6}$, we obtain x=5.01 and z=3; thus, $P_d$=0.999. We see that by increasing (SNR)-value, we could obtain both excellent values of threshold probabilities: very low $\tau\overline{FAR}$ value ($10^{-6}$)

while preserving still high $P_d$-value (99.9%). Of course, for higher $P_d$-value; e.g., Pd>99.99%, we have z=4, and from (SNR)=8, we obtain x=4; thus $\tau\overline{FAR}=10^{-4}$; i.e., this negative probability will be larger than previous value ($10^{-6}$); thus, confirming trade-off rule.

Figure 25B:
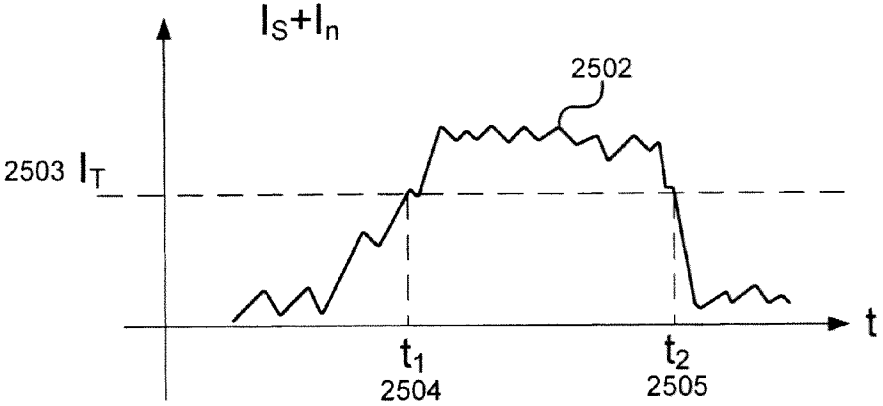
FIG. 25 illustrates a method of pulse detection using thresholding implemented in accordance with an embodiment of the invention.
Figure 25A:
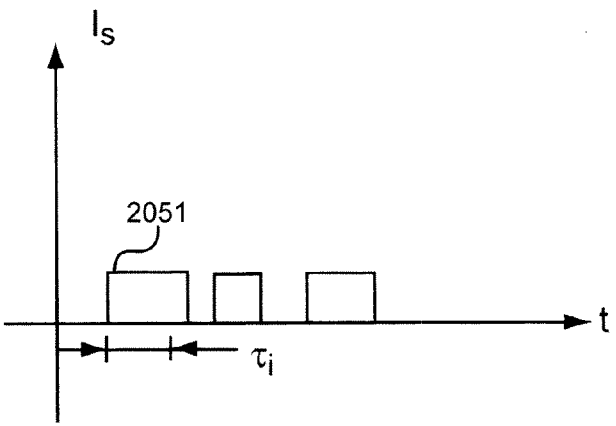

FIG. 25 illustrates a method of pulse detection using thresholding implemented in accordance with an embodiment of the invention. FIG. 25A illustrates a series of pulses transmitted by a light source in an optical proximity fuze. FIG. 25B illustrates the pulse 2502 received after transmission of pulse 2051. As illustrated, noise $I_n$ results in distortion of the signal. A threshold $I_T$ 2503 may be established for the detector to register a detected pulse. Accordingly, pulse start time 2504 and end time 2505 may be detected as the time when the wave 2505 crosses the threshold 2503.

Figure 26:
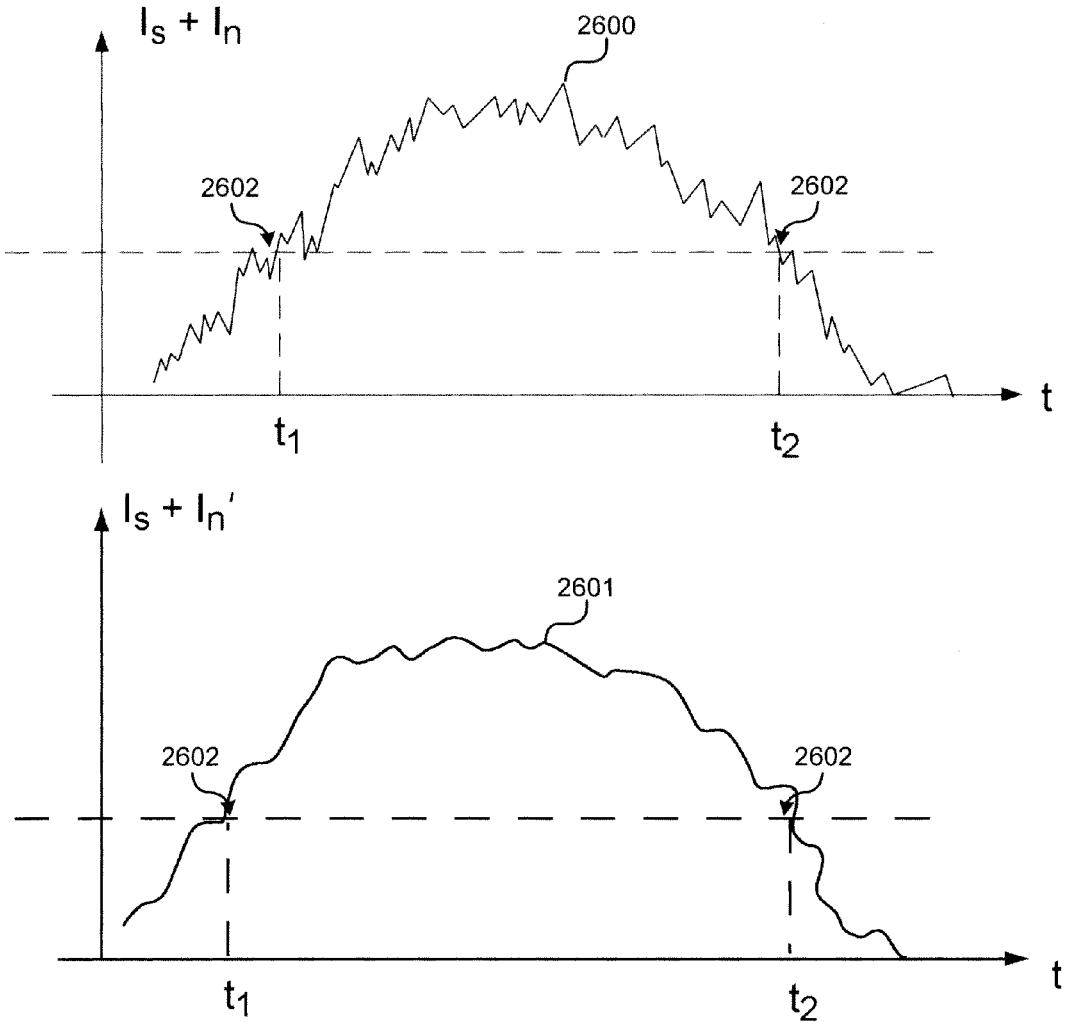
FIG. 26 illustrates a method of pulse detection using low pass filtering and thresholding implemented in accordance with an embodiment of the invention.

For a high value of the threshold 2503, $I_T$, the z-parameter will be low; thus, probability of detection will be also low, while for a low $I_T$-value 2503, x-parameter will be low; thus, the False Alarm Rate (FAR) will be high. In some embodiments, a low pass filter is used in the detection system to smooth out the received pulse. FIG. 26 illustrates this process. An initially received pulse 2600 has many of its high frequency components removed after passage through a low pass filter, resulting in smoothed wave pulse 2601. This low pass operation results in less ambiguity in the regions 2602 where the pulses cross the threshold value.

As the initially transmitted wave pulses do not include components above a certain frequency level, the noise signal intensity, $I_n$, may be reduced to a smoothed value, $I_n'$, as in FIG. 26. Therefore, the signal-to-noise ratio, $(SNR)=I_s/I_n$ is increased into new value:

$$(SNR)' = \frac{I_s}{I_n'} > (SNR) = \frac{I_s}{I_n}. \tag{65}$$

Therefore, the trade-off between $P_d$ and (FAR) will be also improved. According to Eq. (60), $$(SNR)=x+z \tag{66}$$

In some embodiments, the x value is increased, with increasing (SNR)-value, due to Eq. (65), in order to reduce $\tau\overline{FAR}$-value, as in Eq. (57). This is because, with increasing (SNR)-value, due to the smoothing technique, as in Eq. (65), we can increase x-value, while keeping z-value constant, according to Eq. (66), results in minimizing $\tau\overline{FAR}$-value, due to Eq. (57). For example, if before the smoothing technique, illustrated in FIG. 21, $\tau\overline{FAR}$-value was $10^{-4}$, then, with increasing (SNR)-value due to smoothing technique by 1, x-value could also increase by 1 (while keeping z-value the same). Then, according to Table 1, $\tau\overline{FAR}$-value will decrease from $10^{-4}$ to $10^{-6}$, which is a significant improvement of system performance.

In summary, by introducing of the smoothing technique, or low-pass-filtering, we increase (SNR)-value, which, in turn, improves the trade-off between two threshold probabilities: $\tau\overline{FAR}$ and $P_d$. Then, the threshold value, $I_T$ is defined by this new, improved trade-off. In a particular embodiment, a procedure of finding threshold value, $(I_T)_o$ is as follows.

STEP 1. Provide experimental realization of FIG. 25B, in order to determine experimental value of optical intensity, $I_n'$.

STEP 2. Determine, by calibration, the conservative signal value, $I_s$, for a given phase of optical impact duration, including: rising phase, maximum phase, and declining phase. Find (SNR)'-value according to Eq. (65): $(SNR)'= I_s/I_n'$.

STEP 3. Apply relation (66): (SNR)'=x+z, and two definitions of threshold probabilities: Eq. (57) and Eq. (59). Determine required value of $\tau\overline{FAR}$ and use approximate Table 1, or exact relation (57) in order to find x-value: $x=I_T/I_n'$. Then, the resulted threshold value, $I_T$, is found.

STEP 4. Using x-value from STEP 3, find z-value from Eq. (66), and then find $P_d$-value from approximate Table 2, or exact relation (59). If the resulted $P_d$-value is satisfactory the procedure ends. If not, verify $I_s$-statistics, and/or try to improve smoothing procedure. Then, repeat procedure, starting from STEP 1.

Determining zero-points: $t_1$, $t_2$, $t_3$, $t_4$, . . . , as in FIG. 22 depends on pulse temporal length variation, $\tau$, as in FIG. 25A, defined in the form:

$$t_{i+1}-t_i=\tau_i \tag{67}$$

where for i=2, we have: $t_3-t_2=\tau_2$, etc. Therefore, $\tau_i$ defines ith pulse temporal length which can be varying, or it can be constant for periodic signal:

$$\tau_i=\text{constant}=\tau \tag{68}$$

where Eq. (68) is particular case of Eq. (67).

In the periodic signal case, the precision of the pulse length coding can be very high because it is based on a priori information which is known for the detector circuit, for example, using synchronized detection. However, even in the general case (67), the precision can be still high, since a priori information about variable pulse length can be also known for detector circuit.

Figure 27:
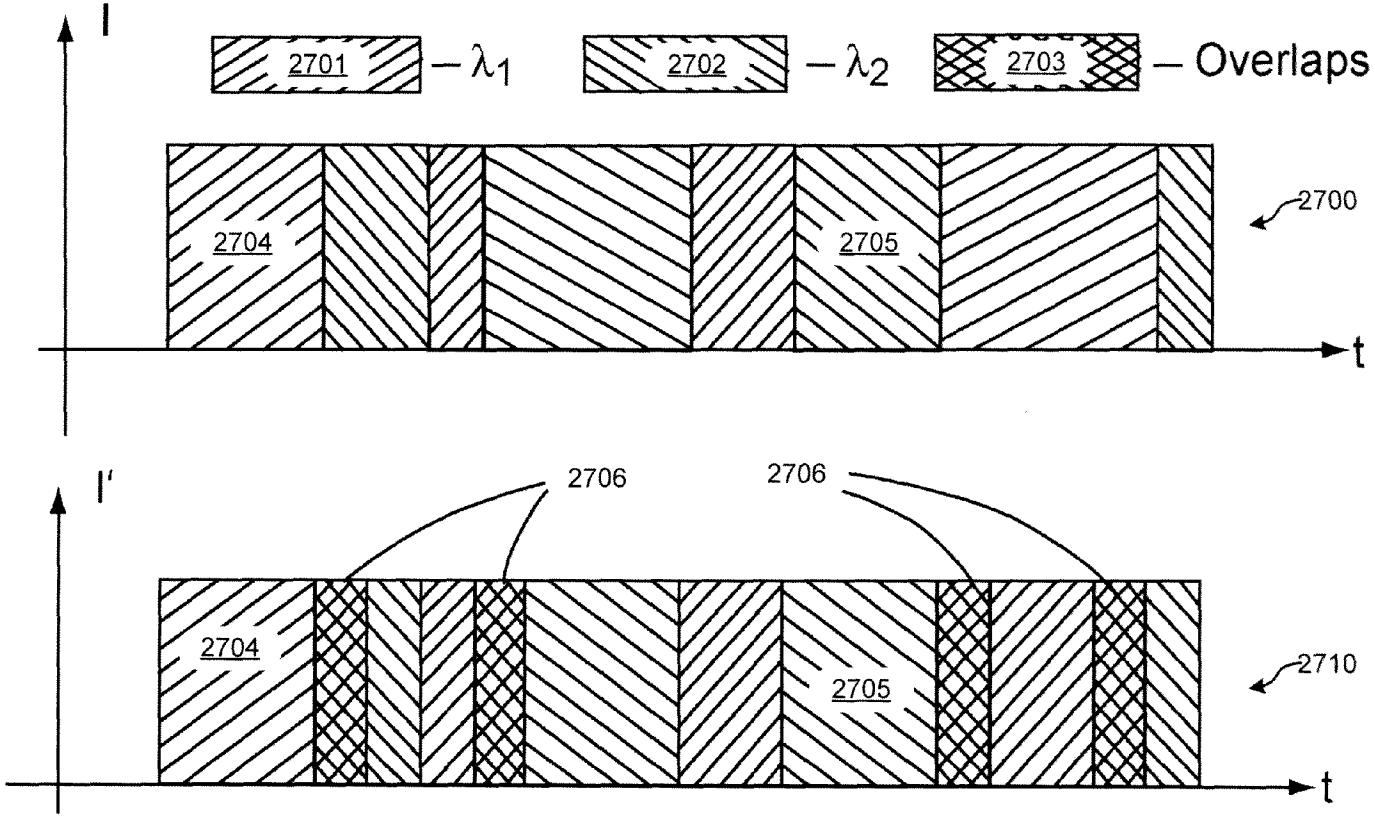
FIG. 27 illustrates a multi-wavelength variable pulse coding operation implemented in accordance with an embodiment of the invention.

In further embodiments, multi-wavelength variable pulse coding may be implemented. FIG. 27 illustrates such an embodiment. In a first embodiment 2700, light sources of a plurality of light sources are configured to emit a first wavelength of light 2701 or a second wavelength of light 2702. The light sources operate in a complimentary, or non-overlapping manner, such that different wavelengths 2704 and 2705 are always transmitted at different times. The particular wavelengths and the pulse lengths allow for temporal and wavelength signatures that may be used for false alarm mitigation. In a second embodiment 2710, the light sources operate in an overlapping manner, resulting in times 2706 when both wavelengths are transmitted. As described above, the use of different filters allows both wavelengths to be detected, and the overlapping times provide another signature for false alarm mitigation Increasing signal, $I_s$, level, is direct way to improve system performance by increasing (SNR)-value, and; thus, automatically improving the trade-off between two threshold probabilities discussed above. In some embodiments, an energy harvesting subsystem 2800 may utilized to increase the energy available for the optical proximity detection system. Current drawn from the projectile engine 2803 during flight time $\Delta t_o$ is stored in the subsystem 2800 and used during detection. An altitude sensor may be used for determining when the optical proximity fuze should begin transmitting light. Assuming flight length of 2 km and projectile speed of 400 m/sec, we obtain; $\Delta t_o$=5 sec, which is G times more than the fuze's necessary time window, W, which is predetermined using a standard altitude sensor (working with accuracy of 100 m, for example). For example, if W=250 msec, then $G=(\Delta t_o)/W\sim 20$. Since the power is drawn from the engine during all the time, $\Delta$to, we can cumulate this power during much shorter W-time; thus, increasing $I_s$-signal by G-factor.

Therefore, G-factor, defined as:

$$G = \frac{(\Delta t_o)}{W}. \tag{69}$$

is called Gain Factor. For the above specific example: G=20, but this value can be increased by reducing W-value, which can be done with increasing altitude sensor accuracy. For example, for W=50 m and for the same remaining parameters, we obtain G=40. Consider, for example, that the DC-current dream is 1 A, and nominal voltage is 12 V, then DC-power is 12 W. However, by applying the Gain Factor, G, with G=20, for example, we obtain the new power of: 20×12 W=240 W, which is a very large value. Then, the signal level, $I_s$, will increase proportionally; thus, also (SNR)-value; and we obtain, $$(\mathrm{SNR})'=(\mathrm{SNR})(G) \tag{70}$$

Figure 28:
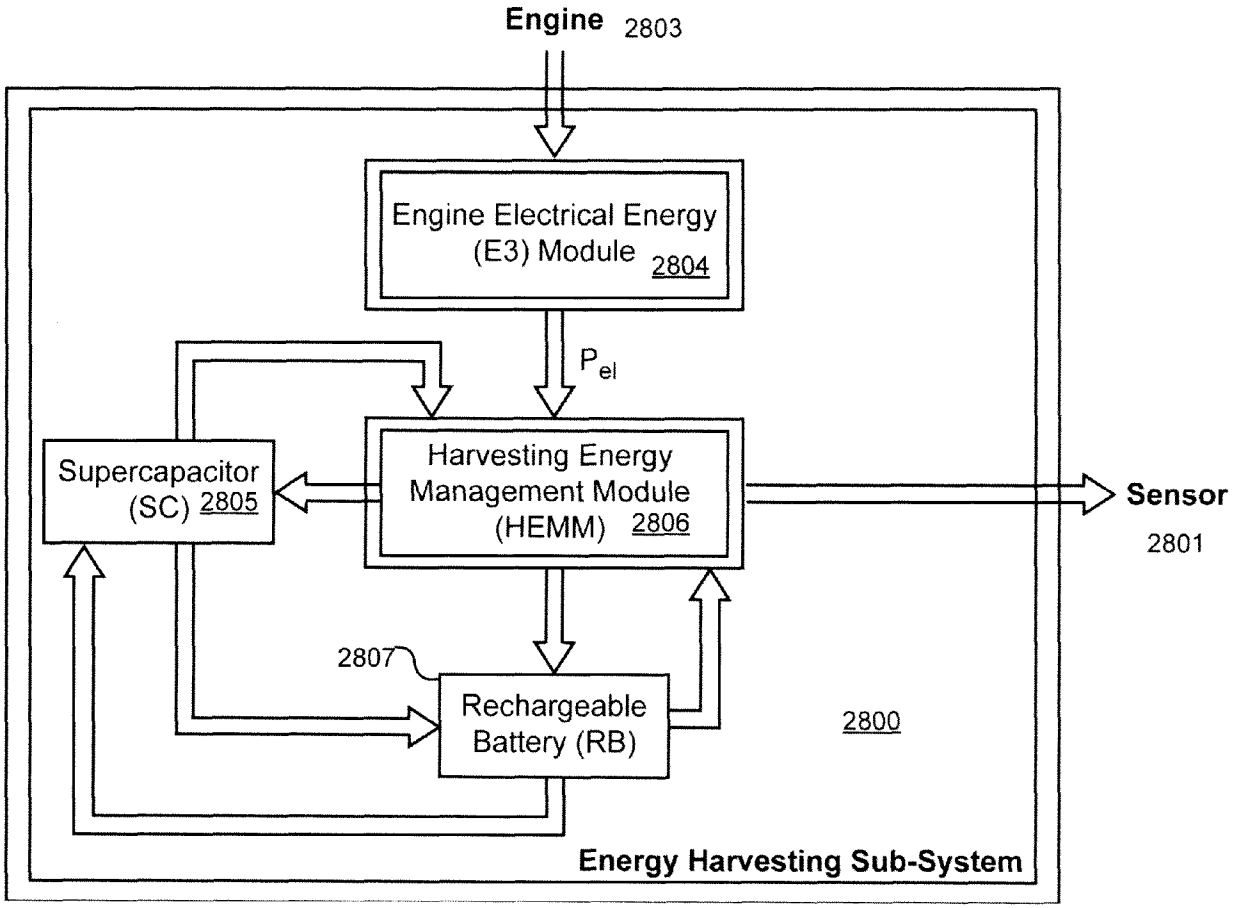
FIG. 28 illustrates an energy harvesting subsystem 2800 implemented in accordance with this embodiment.

FIG. 28 illustrates an energy harvesting subsystem 2800 implemented in accordance with this embodiment. A rechargeable battery 2807 may be combined with a supercapacitor 2805, or either component may be used alone, for temporary electrical energy storage. In a particular embodiment, for example, where electrical charge and spaces for the system are both at a premium, the supercapacitor 2805 is used in combination with the batter 2807. This allows the relative strengths of each system to be utilized.

A harvesting energy management module (HEMM) 2806 controls the distribution of the electrical power, from an engine 2803, $P_{el}$. The power is stored in the battery 2807 or supercapacitor 2805 and then, transmitted into the sensor. The electrical energy is stored and accumulated during the flight time $\Delta t_o$ (or, during part of this time), while transmitted into the sensor, during window time, W. For example, the HEMM 2806 may draw power from an Engine Electrical Energy (E3) module installed to serve additional sub-systems with power. In a particular embodiment, the battery's 2807 form factor is configured such that its power density is maximized; i.e., the charge electrode proximity (CEP) region should be enlarged as possible. This is because the energy can be quickly stored and retrieved from the CEP region only.

Figure 29:
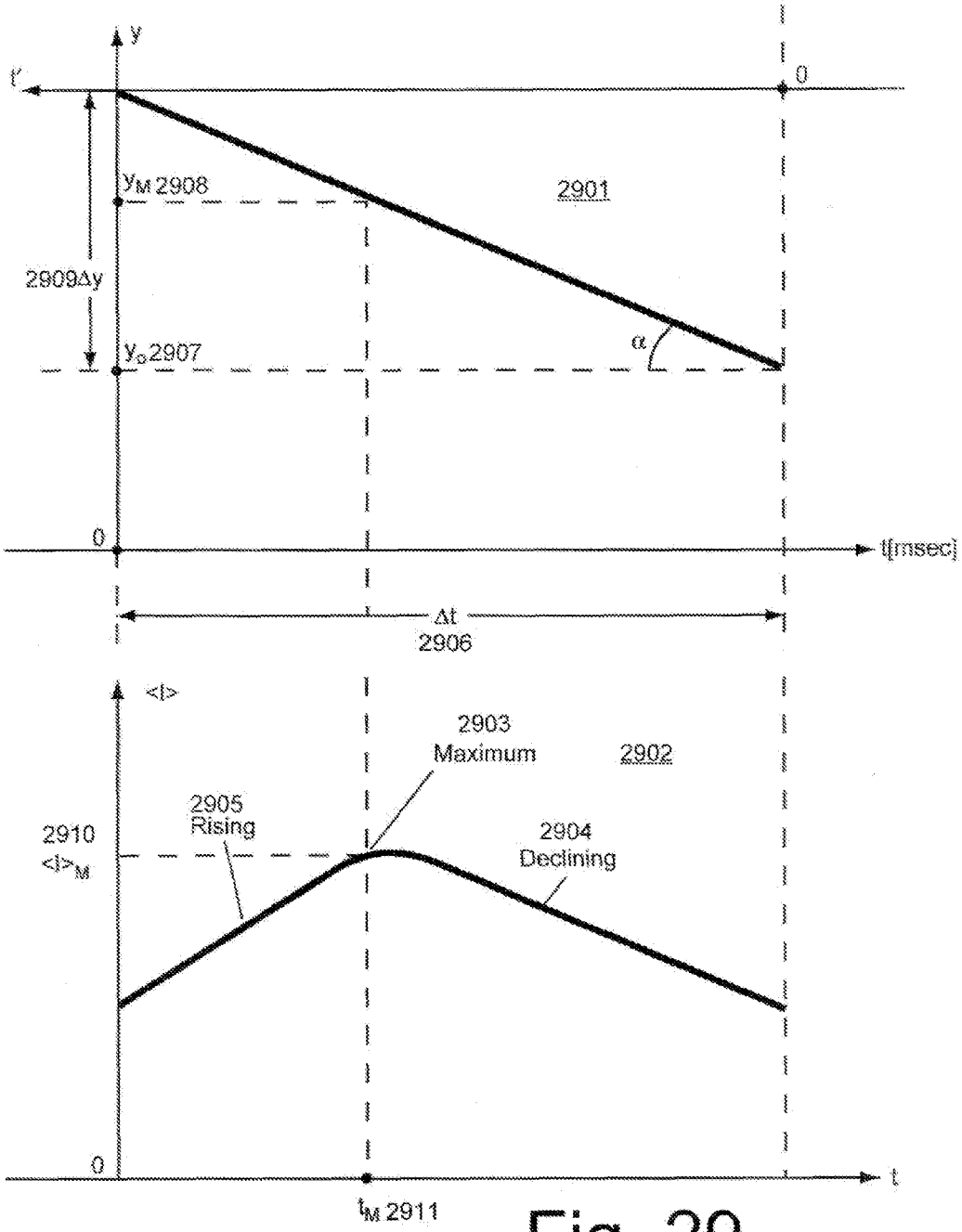
FIG. 29 illustrates an optical impact profile during target detection in accordance with an embodiment of the invention.

As discussed above, the geometry of the optical proximity detection fuze results in a detection signal that first rises in intensity to a maximum value then begins to decline. FIG. 29 illustrates this in terms of a optical impact effect (OIE), which is defined, using mean signal intensity (<I>) maximization, when, in time: $t=t_M$:

$$\langle I\rangle=\langle I\rangle_M, \text{ for } t=t_M \tag{71}$$

where $I=I_s+I_n'$, after signal smoothing, due to low-pass filtering (LPF). The OIE measurement is based on time budget analysis.

In FIG. 29, the upper graph 2901 illustrates a trajectory of a projectile. The lower graph 2902 illustrates the means signal intensity received at a photodetector within the optical proximity fuze. The time axis of both graphs is aligned for illustrative purposes. In the illustrated embodiment, the fuze is configured to activate the projectile at a predetermined distance $y_0$ 2907. In this embodiment, the activation distance 2907 is aligned with the end of the time window 2906 in which the target can be detected. However, in other embodiments, the predetermined activation distance can be situated at other points within the detection range. The range in which the target can be detected 2909 is determined according to the position of the photodetectors relative to the receiving aperture of the optical proximity fuze. At the start of a detection operation, the optical proximity fuze begins transmitting light towards the target. Light begins being detected by the photodetector at the start of window 2906. As the light spot reflected off the target traverses the photodetector, the mean intensity 2910 increases to a maximum value 2903 and then declines 2904 to a minimum value.

For example, consider Δy=10 m; then, for v=400 m/sec, Δt=25 msec. Then, $y_o$-value can be also 10 m (a distance from the ground when optical impact occurs), or some other value of the same order of magnitude. In order to define the OIE, we divide this Δt-time on time decrements, δt, such that δy=4 cm, for example. Then, for the same speed, δt=0.1 msec=100 μsec.

Therefore, in this example, the number of decrements, during optical pact phase, Δt, is $$M = \frac{\Delta t}{\delta t} = \frac{25 \text{ msec}}{0.1 \text{ msec}} = 250 \tag{72}$$

which is sufficient number to provide the effective statistical average (or, mean value) operation, defined, as $$\langle I\rangle = \frac{\int_t^{t+\delta t} I(t)\,dt}{\delta t} \tag{73}$$

which can be done either in digital, or in analog domain. The I(t)-function can have various profiles, including pulse length modulation, as discussed above. Then, assuming time average pulse length, $\bar{\tau}$=100 nsec=0.1 μsec, the total number of pulses per decrement, δt, is: 0.1 msec/0.1 μsec=1000.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. An optical impact control system, comprising:

a laser light source configured to emit laser light comprising a plurality of orthogonal wavelengths;

a first aperture configured to pass the light from the plurality of laser light sources and to direct the light to a target;

a second aperture configured to pass the light reflected off of the target;

a photodetector configured to detect the laser light having the plurality of orthogonal wavelengths after the light is passed through the second aperture only if the target is within a predetermined distance range from the optical impact control system.

2. The apparatus of claim 1, wherein the light from the plurality of laser light sources is temporally multiplexed and wherein the wavelengths of the light are temporally modulated.

3. The apparatus of claim 1, wherein the light from the plurality of laser light sources is spatially multiplexed.

4. The apparatus of claim 1, wherein the first aperture is an element of an optical projection system, the optical projection system configured to project the light such that the light is substantially in focus within the predetermined distance range.

5. The apparatus of claim 4, wherein the optical projection system further comprises a cylindrical lens.

6. The apparatus of claim 4, wherein the optical projection system further comprises a collimating lens.

7. The apparatus of claim 1, wherein the second aperture is an element of an optical imaging system, the optical imaging system configured to image the light such that the light is substantially in focus when reflected from the target when the target is within the predetermined distance range.

8. The apparatus of claim 7, wherein the optical imaging system further comprises a cylindrical lens.

9. The apparatus of claim 1, wherein the photodetector comprises a non-position sensitive photodiode coupled to a detection circuit.

10. The apparatus of claim 1, wherein the photodetector comprises a position sensitive photodiode coupled to a detection circuit, wherein the photodetector is configured to detection position by measuring an area of an active region of the photodiode that is illuminated by the reflected light compared to the total area of the active region.

11. The apparatus of claim 1, wherein the photodetector comprises an array of photodiodes coupled to a detection circuit.

12. The apparatus of claim 1, further comprising an ogive housing the laser light source, the first aperture, the second aperture, and the photodetector; and wherein the photodetector is an element of an array of photodetectors positioned in an axially symmetric manner on the ogive.

13. The apparatus of claim 1, further comprising:

an ogive comprising a first ogive portion and a second ogive portion;

a first separating means for separating the ogive from a projectile; and a second separating means for separating the first ogive portion from the second ogive portion; and wherein the first ogive portion houses the laser light source and the first aperture, and the second ogive portion houses the photodetection and the second aperture.

14. A munition system, comprising:

a projectile; and an optical impact control system coupled to the projectile and configured to transmit a target detection signal to the projectile; wherein the optical impact control system comprises:

a laser light source configured to emit laser light comprising a plurality of orthogonal wavelengths;

a first aperture configured to pass the light from the plurality of laser light sources and to direct the light to a target;

a second aperture configured to pass the light reflected off of the target;

a photodetector configured to detect the laser light having the plurality of orthogonal wavelengths after the light is passed through the second aperture only if the target is within a predetermined distance range from the optical impact control system.

15. The system of claim 14, wherein the light from the plurality of laser light sources is temporally multiplexed and wherein the wavelengths of the light are temporally modulated.

16. The system of claim 14, wherein the light from the plurality of laser light sources is spatially multiplexed.

17. The system of claim 14, wherein the first aperture is an element of an optical projection system, the optical projection system configured to project the light such that the light is substantially in focus within the predetermined distance range.

18. The system of claim 17, wherein the optical projection system further comprises a cylindrical lens.

19. The system of claim 17, wherein the optical projection system further comprises a collimating lens.

20. The system of claim 14, wherein the second aperture is an element of an optical imaging system, the optical imaging system configured to image the light such that the light is substantially in focus when reflected from the target when the target is within the predetermined distance range.

21. The system of claim 20, wherein the optical imaging system further comprises a cylindrical lens.

22. The system of claim 14, wherein the photodetector comprises a non-position sensitive photodiode coupled to a detection circuit.

23. The system of claim 14, wherein the photodetector comprises a position sensitive photodiode coupled to a detection circuit, wherein the photodetector is configured to detection position by measuring an area of an active region of the photodiode that is illuminated by the reflected light compared to the total area of the active region.

24. The system of claim 14, wherein the photodetector comprises an array of photodiodes coupled to a detection circuit.

25. The system of claim 14, further comprising an ogive housing the laser light source, the first aperture, the second aperture, and the photodetector; and wherein the photodetector is an element of an array of photodetectors positioned in an axially symmetric manner on the ogive.

26. The system of claim 14, further comprising:

an ogive comprising a first ogive portion and a second ogive portion;

a first separating means for separating the ogive from a projectile; and a second separating means for separating the first ogive portion from the second ogive portion; and wherein the first ogive portion houses the laser light source and the first aperture, and the second ogive portion houses the photodetection and the second aperture.

* * * * *